US009751346B2

(12) United States Patent
Hishinuma et al.

(10) Patent No.: US 9,751,346 B2
(45) Date of Patent: Sep. 5, 2017

(54) LIQUID EJECTION HEAD, LIQUID EJECTION HEAD PRODUCTION METHOD AND LIQUID EJECTION HEAD PRODUCTION SYSTEM

(71) Applicant: FUJIFILM Corporation, Tokyo (JP)

(72) Inventors: Yoshikazu Hishinuma, Ashigarakami-gun (JP); Tadashi Kyoso, Ashigarakami-gun (JP); Yasutoshi Hirabayashi, Ashigarakami-gun (JP); Satoshi Shimobayashi, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/224,215

(22) Filed: Jul. 29, 2016

(65) Prior Publication Data

US 2017/0028751 A1 Feb. 2, 2017

(30) Foreign Application Priority Data

Jul. 31, 2015 (JP) ..... 2015-152106

(51) Int. Cl.
*B41J 2/155* (2006.01)
*B41J 2/515* (2006.01)
(Continued)

(52) U.S. Cl.
CPC ..... *B41J 25/001* (2013.01); *B41J 2/145* (2013.01); *B41J 2/155* (2013.01); *B41J 2/2128* (2013.01);
(Continued)

(58) Field of Classification Search
CPC .... B41J 2/04508; B41J 2/04586; B41J 2/145; B41J 2/155; B41J 2/2128; B41J 2/2146;
(Continued)

(56) References Cited

U.S. PATENT DOCUMENTS 7,182,815 B2 * 2/2007 Katagami ..... B41J 2/155 118/315
7,278,699 B2 * 10/2007 Drake ..... B41J 2/2146 347/12
(Continued)

FOREIGN PATENT DOCUMENTS

JP 2007-22092 A 2/2007
JP 2007-160834 A 6/2007
JP 2015-47633 A 3/2015

OTHER PUBLICATIONS

Extended European Search Report, dated Feb. 2, 2017, for European Application No. 16181844.8.

*Primary Examiner* — Anh T. N. Vo
(74) *Attorney, Agent, or Firm* — Birch, Stewart, Kolasch & Birch, LLP

(57) ABSTRACT

The liquid ejection head has a structure in which three or more head modules including a plurality of ejection elements are arranged along a single direction, and the liquid ejection head includes a first head module, a second head module and a third head module which are arranged in ascending order of slope of ejection volume distribution in the single direction or are arranged in descending order of the slope of the ejection volume distribution in the single direction, the slope of the ejection volume distribution in the single direction being evaluated by subtracting an ejection volume at one end part in the single direction from an ejection volume at the other end part in the single direction.

12 Claims, 35 Drawing Sheets

(51) Int. Cl.

| | |
|---|---|
| ***B41J 25/00*** | (2006.01) |
| ***B41J 2/51*** | (2006.01) |
| ***B41J 2/21*** | (2006.01) |
| ***B41J 2/145*** | (2006.01) |

(52) U.S. Cl.
CPC ..... *B41J 2/2146* (2013.01); *B41J 2/51* (2013.01); *B41J 2/515* (2013.01); *B41J 2202/11* (2013.01); *B41J 2202/19* (2013.01); *B41J 2202/20* (2013.01); *B41J 2202/21* (2013.01); *B41J 2202/22* (2013.01)

(58) Field of Classification Search
CPC . B41J 2/51; B41J 2/515; B41J 2202/20; B41J 2202/21; B41J 2202/22
See application file for complete search history.

(56) References Cited

U.S. PATENT DOCUMENTS

| | | | | |
|---|---|---|---|---|
| 7,368,149 | B2 * | 5/2008 | Katagami | B41J 2/2114 427/162 |
| 9,412,946 | B2 * | 8/2016 | Chen | H01L 51/0005 |
| 2004/0246298 | A1 * | 12/2004 | Ito | B41J 2/15 347/40 |
| 2006/0188308 | A1 | 8/2006 | Tanaka et al. | |
| 2016/0167365 | A1 | 6/2016 | Hirabayashi | |

* cited by examiner

LIQUID EJECTION HEAD, LIQUID EJECTION HEAD PRODUCTION METHOD AND LIQUID EJECTION HEAD PRODUCTION SYSTEM

CROSS-REFERENCE TO RELATED APPLICATIONS

The present application claims priority under 35 U.S.C. §119 to Japanese Patent Application No. 2015-152106, filed on Jul. 31, 2015. The above application is hereby expressly incorporated by reference, in its entirety, into the present application.

BACKGROUND OF THE INVENTION

Field of the Invention

The present invention relates to a liquid ejection head, a liquid ejection head production method and a liquid ejection head production system, and particularly, relates to a structure of a liquid ejection head having a structure in which a plurality of head modules are arrayed in a single direction.

Description of the Related Art

There is known an ink-jet printing apparatus including a line-type ink-jet head having a structure in which a plurality of nozzles are provided over a length corresponding to the total width of a medium. As the line-type ink-jet head, a structure of arraying, in the width direction of the medium, a plurality of head modules in each of which a plurality of nozzle parts are arranged in a matrix can be employed.

Japanese Patent Application Laid-Open No. 2015-047833 describes a liquid ejection head configured to joint, in a single direction, a plurality of head modules in each of which a plurality of nozzle parts to eject liquid are arrayed. The liquid ejection head described in Japanese Patent Application Laid-Open No. 2015-047833 is configured to alternately joint a first head module in which the ejection volume of the liquid at one end part of the head module with respect to the array direction of the head module is greater than the ejection volume of the liquid at the other end part and a second head module in which the ejection volume of the liquid at the other end part is greater than the ejection volume of the liquid at one end part, and thereby, the density unevenness at joint parts of the head modules is suppressed.

Here, the terms "droplet", "ejection amount" and "recording head" described in Japanese Patent Application Laid-Open No. 2015-047833 correspond to the terms "liquid", "ejection volume" and "liquid ejection head" in the specification, respectively.

Japanese Patent Application Laid-Open No. 2007-022092 describes an ink-jet recording apparatus that generates image data such that a line graph showing density change characteristic depicts a line having a grade when the density change characteristic of an image to be drawn by the liquid ejection head is shown as the line graph, and that performs the drawing based on the generated image data.

The ink-jet printing apparatus described in Japanese Patent Application Laid-Open No. 2007-022092 performs such a control that the density changes continuously and gradually, allowing for the inconspicuousness of the image degradation due to the density unevenness by the liquid ejection head.

Here, the terms "printing head" and "ink-jet printer" described in Japanese Patent Application Laid-Open No. 2007-022092 correspond to the terms "liquid ejection head" and "ink-jet recording apparatus" in the specification, respectively.

Japanese Patent Application Laid-Open No. 2007-160834 describes a liquid ejection head in which a plurality of head modules are arranged along the array direction of nozzles. By arranging the head modules in order of the magnitude of average ejection volume or by equalizing the first head module and the N-th head module in average ejection volume, the liquid ejection head described in Japanese Patent Application Laid-Open No. 2007-160834 reduces the density unevenness caused by the difference in ejection volume among the head modules, and achieves the improvement in image quality.

Here, the terms "recording element substrate", "ejection amount" and "ink-jet recording head" in Japanese Patent Application Laid-Open No. 2007-160834 correspond to the terms "head module", "ejection volume" and "liquid ejection head" in the specification, respectively.

SUMMARY OF THE INVENTION

However, in the liquid ejection head described in Japanese Patent Application Laid-Open No. 2015-047833, in the case where the relative difference in ejection volume between the first head module and the second head module is large, it is difficult to suppress the appearance of the density unevenness at the joint part between the first head module and the second head module.

The ink-jet printing apparatus described in Japanese Patent Application Laid-Open No. 2007-022092, in the case where the difference in ejection volume between adjacently arranged head modules is large, fails to correct the image data, and it is difficult to suppress the appearance of the density unevenness.

In the liquid ejection head described in Japanese Patent Application Laid-Open No. 2007-160834, the variation in ejection volume within individual head modules is not considered, although the variation in average ejection volume between adjacently arranged head modules is considered. Hence, the difference in ejection volume between the mutually adjacent end parts of adjacently arranged head modules is sometimes large, and it is not possible to suppress the level difference in density at the joint part between the adjacently arranged head modules, resulting in a fear of the appearance of the density unevenness.

The present invention has been made in view of such a circumstance, and has an object to provide a liquid ejection head, a liquid ejection head production method and a liquid ejection head production system that make it possible to suppress the deterioration in image quality at the joint part between head modules of the liquid ejection head having a structure in which a plurality of head modules are jointed in a single direction.

For achieving the above object, the following invention aspects are provided.

A liquid ejection head according to a first aspect is a liquid ejection head having a structure in which three or more head modules are arranged along a single direction, each of the three or more head modules including a plurality of ejection elements, the liquid ejection head including: a first head module; a second head module that has a joint part with the first head module on one end side in the single direction, the second head module being arranged at an arrangement position that is adjacent to the other end side of the first head module in the single direction; and a third head module that has a joint part with the second head module on one end side in the single direction, the third head module being arranged at an arrangement position that is adjacent to the other end side of the second head module in the single direction, the first head module, the second head module and the third head module being arranged in ascending order of slope of ejection volume distribution in the single direction or being arranged in descending order of the slope of the ejection volume distribution in the single direction, the slope of the ejection volume distribution in the single direction being evaluated by subtracting an ejection volume at one end part in the single direction from an ejection volume at the other end part in the single direction.

According to the first aspect, the first head module, the second head module and the third head module are arranged in order of the slope of the ejection volume distribution in the single direction. Therefore, in the first head module, the second head module and the third head module, the ejection volume at the joint part between two head modules that are arranged at adjacent positions is close to the average ejection volume in the whole of the liquid ejection head, and the deterioration in ejection characteristic at the joint part is suppressed.

The ejection volume is the volume of a unit liquid that is ejected from the ejection element. The unit liquid is a liquid that forms one dot. As the mode in which the unit liquid is ejected, there is a mode in which all of the liquid that forms one dot is ejected by one ejection operation, or a mode in which all of the liquid that forms one dot is ejected by multiple ejection operations.

In the first aspect, the first head module, the second head module and the third head module can be configured to include head modules that are different in the positive and negative of the slope of the ejection volume distribution in the single direction.

According to such a mode, even when the positive and negative of the slope of the ejection volume distribution cannot be matched for all head modules, it is possible to suppress the deterioration in ejection characteristic at the joint part, as the whole of the liquid ejection head.

A second aspect, in the liquid ejection head of the first aspect, can adopt a configuration in which all head modules including the first head module, the second head module and the third head module are arranged in the ascending order of the slope of the ejection volume distribution in the single direction or are arranged in the descending order of the slope of the ejection volume distribution in the single direction.

According to the second aspect, since all head modules are arranged in the ascending order or descending order of the slope of the ejection volume distribution in the single direction, it is possible to suppress the deterioration in ejection characteristic at the joint part, as the whole of the liquid ejection head.

A third aspect, in the liquid ejection head of the first aspect or the second aspect, can adopt a configuration in which, in the first head module, the second head module and the third head module, the slopes of the ejection volume distributions in the single direction are all positive or all negative.

According to the third aspect, it is possible to restrain the ejection volume from being excessive at the joint part, and it is possible to obtain a preferable graininess.

A fourth aspect, in the liquid ejection head of the first aspect or the second aspect, can adopt a configuration in which, in all head modules including the first head module, the second head module and the third head module, the slopes of the ejection volume distributions in the single direction are all positive or all negative.

According to the fourth aspect, the ejection volume is restrained from being excessive at the joint part, as the whole of the liquid ejection head, and it is possible to obtain a preferable graininess.

A fifth aspect, in the liquid ejection head of any one aspect of the first aspect to the fourth aspect, can adopt a configuration in which, in head modules that are of the first head module, the second head module and the third head module and that are arranged at adjacent arrangement positions, an ejection volume of an ejection element provided in a head module in which an ejected liquid impacts earlier exceeds an ejection volume of an ejection element provided in a head module in which an ejected liquid impacts later.

According to the fifth aspect, the deviation of impact position due to impact interference is suppressed.

As a sixth aspect, in the liquid ejection head of any one aspect of the first aspect to the fifth aspect, each of the first head module, the second head module and the third head module includes an ejection volume distribution slope storage unit in which the slope of the ejection volume distribution in the single direction is stored.

According to the sixth aspect, when the slope of the ejection volume distribution of each head module is acquired, it is possible to use the slope of the ejection volume distribution that is stored in the ejection volume distribution slope storage unit provided in each head module. A seventh aspect, in the liquid ejection head of any one aspect of the first aspect to the sixth aspect, can adopt a configuration in which, for the first head module, the second head module and the third head module, the slope of the ejection volume distribution in the single direction is derived using a measurement value, the measurement value being obtained by measuring a liquid that is ejected by applying an ejection duty, the ejection duty being 80 percent or more of the maximum value of the ejection volume of a droplet that is used in liquid ejection.

According to the seventh aspect, the liquid ejection is performed by applying a high liquid ejection duty, and thereby, it is possible to use the slope of the ejection volume distribution that reflects the ejection characteristic of the real head module.

An eighth aspect is a liquid ejection head production method for producing a liquid ejection head having a structure in which three or more head modules are arranged along a single direction, each of the three or more head modules including a plurality of ejection elements, the liquid ejection head production method including: a selection step of collectively selecting three or more head modules or sequentially selecting three or more head modules; an ejection volume distribution slope acquisition step of acquiring slope of ejection volume distribution in the single direction, for each of the three or more head modules selected in the selection step, the slope of the ejection volume distribution in the single direction being derived from an ejection volume at one end part in the single direction and an ejection volume at the other end part in the single direction; a setting step of setting an arrangement in ascending order or descending order of the slope of the ejection volume distribution in the single direction for the three or more head modules acquired in the ejection volume distribution slope acquisition step; and an assembly step of arranging a first head module, a second head module and a third head module along the single direction, based on the arrangement order set in the setting step.

According to the eighth aspect, the first head module, the second head module and the third head module are arranged in order of the slope of the ejection volume distribution in the single direction. Therefore, it is possible to produce a liquid ejection head in which the ejection volume at the joint part between two head modules that are arranged at adjacent positions is close to the average ejection volume in the whole of the liquid ejection head and the deterioration in ejection characteristic at the joint part is suppressed.

In the eighth aspect, the slope of the ejection volume distribution in the single direction may be evaluated by subtracting the ejection volume at the one end part in the single direction from the ejection volume at the other end part in the single direction, or may be evaluated by dividing the ejection volume at the other end part in the single direction by the ejection volume at the one end part in the single direction.

In the eighth aspect, it is preferable that the setting step be a mode of setting the arrangement in the ascending order or descending order of the slope of the ejection volume distribution in the single direction for all head modules including the first head module, the second head module and the third head module.

According to such a mode, since all head modules are arranged in the ascending order or descending order of the slope of the ejection volume distribution in the single direction, it is possible to suppress the deterioration in ejection characteristic at the joint part, as the whole of the liquid ejection head.

In the eighth aspect, it is preferable that the setting step be a mode of setting the arrangement such that in the first head module, the second head module and the third head module, the slopes of the ejection volume distributions in the single direction are all positive or all negative.

According to such a mode, it is possible to restrain the ejection volume from being excessive at the joint part, and it is possible to obtain a preferable graininess.

In the eighth aspect, the arrangement, in the setting step, can be set such that in all head modules including the first head module, the second head module and the third head module, the slopes of the ejection volume distributions in the single direction are all positive or all negative.

According to such a mode, the ejection volume is restrained from being excessive at the joint part, as the whole of the liquid ejection head, and it is possible to obtain a preferable graininess.

In the eighth aspect, the setting step can be a configuration in which the first head module, the second head module and the third head module include head modules that are different in the positive and negative of the slope of the ejection volume distribution in the single direction.

According to such a mode, even when the positive and negative of the slope of the ejection volume distribution cannot be matched for all head modules, it is possible to suppress the deterioration in ejection characteristic at the joint part, as the whole of the liquid ejection head.

In the eighth aspect, the setting step can be a configuration in which, in head modules that are of the first head module, the second head module and the third head module and that are arranged at adjacent arrangement positions, an ejection volume of an ejection element provided in a head module in which an ejected liquid impacts earlier exceeds an ejection volume of an ejection element provided in a head module in which an ejected liquid impacts later.

According to such a mode, the deviation of impact position due to impact interference is suppressed.

In the eighth aspect, the first head module, the second head module and the third head module can be configured such that the slope of the ejection volume distribution in the single direction is stored.

According to such a mode, when the slope of the ejection volume distribution of each head module is acquired, it is possible to use the slope of the ejection volume distribution that is stored in an ejection volume distribution slope storage unit provided in each head module.

The eighth aspect can adopt a configuration in which, for the first head module, the second head module and the third head module, the slope of the ejection volume distribution in the single direction is derived using a measurement value, the measurement value being obtained by measuring a liquid that is ejected by applying an ejection duty, the ejection duty being 80 percent or more of the maximum value of the ejection volume of a droplet that is used in liquid ejection.

According to such a mode, the liquid ejection is performed by applying a high liquid ejection duty, and thereby, it is possible to use the slope of the ejection volume distribution that reflects the ejection characteristic of the real head module.

A ninth aspect, in the liquid ejection head production method of the eighth aspect, can adopt a configuration in which a first candidate head module that is a candidate for the first head module is selected in the selection step, the slope of the ejection volume distribution of the first candidate head module is acquired in the ejection volume distribution slope acquisition step, and the first candidate head module is set in the setting step as a head module that is arranged at an arrangement position of the first head module.

According to the ninth aspect, the first head module is set.

A tenth aspect, in the liquid ejection head production method of the eighth aspect or the ninth aspect, can adopt a configuration in which a second candidate head module that is a candidate for the second head module is selected in the selection step, the slope of the ejection volume distribution of the first head module and the slope of the ejection volume distribution of the second candidate head module are acquired in the ejection volume distribution slope acquisition step, and the second candidate head module is set in the setting step as a head module that is arranged at an arrangement position of the second head module, in a case where the slope of the ejection volume distribution of the first head module and the slope of the ejection volume distribution of the second candidate head module satisfy a relation of the ascending order or the descending order for the first head module and the second head module.

According to the tenth aspect, in the mode of sequentially selecting three or more head modules, it is possible to set the second head module that satisfies the condition of the slope of the ejection volume with respect to the first head module.

An eleventh aspect, in the liquid ejection head production method of any one aspect of the eighth aspect to the tenth aspect, can adopt a configuration in which a third candidate head module that is a candidate for the third head module is selected in the selection step, the slope of the ejection volume distribution of the second head module and the slope of the ejection volume distribution of the third candidate head module are acquired in the ejection volume distribution slope acquisition step, and the third candidate head module is set in the setting step as a head module that is arranged at an arrangement position of the third head module, in a case where the slope of the ejection volume distribution of the second head module and the slope of the ejection volume distribution of the third candidate head module satisfy a relation of the ascending order or the descending order for the second head module and the third head module.

According to the eleventh aspect, in the mode of sequentially selecting three or more head modules, it is possible to set the third head module that satisfies the condition of the slope of the ejection volume with respect to the second head module.

A twelfth aspect is a liquid ejection head production system for producing a liquid ejection head having a structure in which three or more head modules are arranged along a single direction, each of the three or more head modules including a plurality of ejection elements, the liquid ejection head production system including: a selection unit that selects three or more head modules; an election volume distribution slope acquisition unit that acquires slope of ejection volume distribution in the single direction, for each of the three or more head modules selected by the selection unit, the slope of the ejection volume distribution in the single direction being derived from an ejection volume at one end part in the single direction and an ejection volume at the other end part in the single direction; a head module setting unit that sets an arrangement in ascending order or descending order of the slope of the ejection volume distribution in the single direction for the three or more head modules acquired by the ejection volume distribution slope acquisition unit; and an assembly unit that arranges a first head module, a second head module and a third head module along the single direction, based on the arrangement order set by the head module setting unit.

According to the twelfth aspect, the first head module, the second head module and the third head module are arranged in order of the slope of the ejection volume distribution in the single direction. Therefore, it is possible to produce a liquid ejection head in which the ejection volume at the joint part between two head modules that are arranged at adjacent positions is close to the average ejection volume in the whole of the liquid ejection head and the deterioration in ejection characteristic at the joint part is suppressed.

According to the present invention, the first head module, the second head module and the third head module are arranged in order of the slope of the ejection volume distribution in the single direction. Therefore, in the first head module, the second head module and the third head module, the ejection volume at the joint part between two head modules that are arranged at adjacent positions is close to the average ejection volume in the whole of the liquid ejection head, and the deterioration in ejection characteristic at the joint part is suppressed.

DETAILED DESCRIPTION OF THE EMBODIMENTS

Hereinafter, preferable embodiments of the present invention are described in detail with reference to the accompanying drawings.

[Structure of Ink-Jet Head]

<Overall Configuration>

Figure 1:
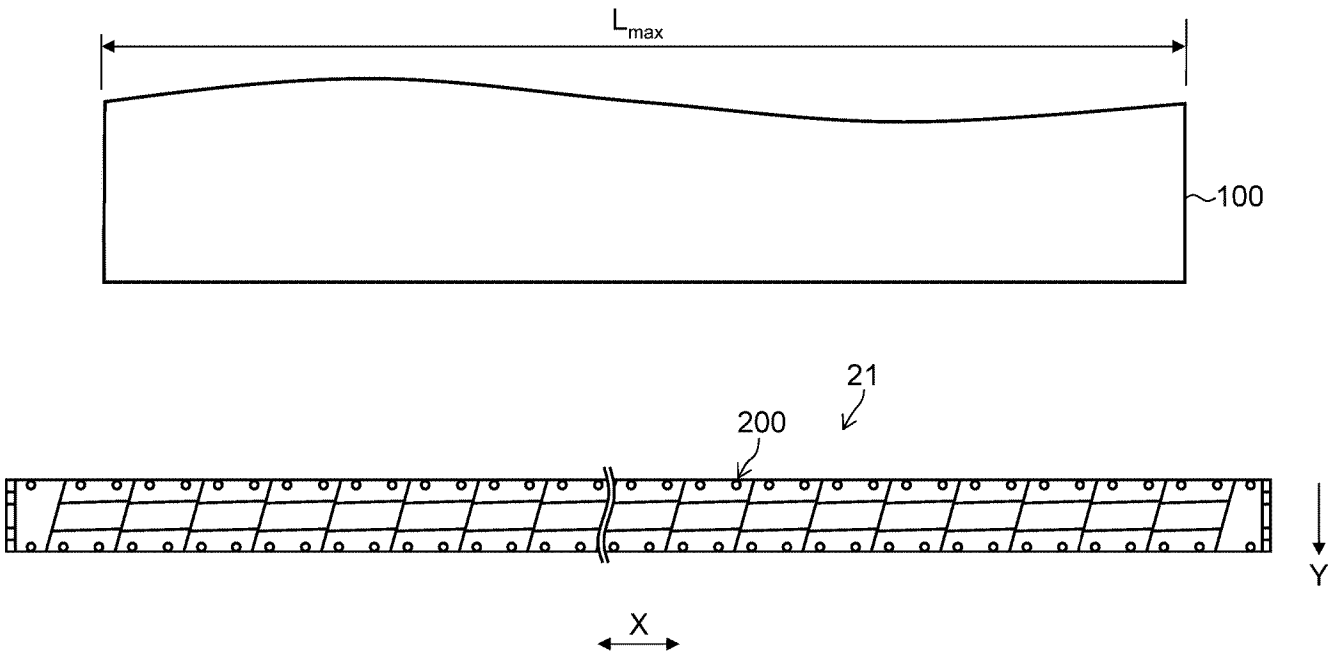
FIG. 1 is a perspective plan view showing a structure example of an ink-jet head.

FIG. 1 is a perspective plan view showing a structure example of an ink-jet head. An ink-jet head 21 shown in FIG. 1 has a structure in which a plurality of head modules 200 are jointed in the width direction of a medium 100 that is the direction orthogonal to the feed direction of the medium 100. The ink-jet head in the specification is a mode of the liquid ejection head.

The structure in which the plurality of head modules 200 are jointed in the width direction of the medium 100 in the embodiment is a mode of the structure in which a plurality of head modules are arranged along a single direction.

The term "orthogonal" in the specification includes the case of being substantially orthogonal that is of the case of a cross at an angle exceeding 90 degrees or the case of a cross at an angle less than 90 degrees and that exhibits a function effect identical to the case of a cross at an angle of 90 degrees.

Further, the term "parallel" in the specification includes the case of being substantially parallel that exhibits a function effect identical to the case of being parallel, although two directions cross. Furthermore, the term "identical" in the specification includes the case of being substantially identical that makes it possible to obtain a similar function effect to the case of being identical, although there a difference in the configuration of the object.

In the specification, the width direction of the medium 100 is sometime described as the X-direction. Further, the feed direction of the medium 100 is sometimes described as the Y-direction or the medium feed direction. These terms can be replaced with each other when appropriate.

Figure 4:
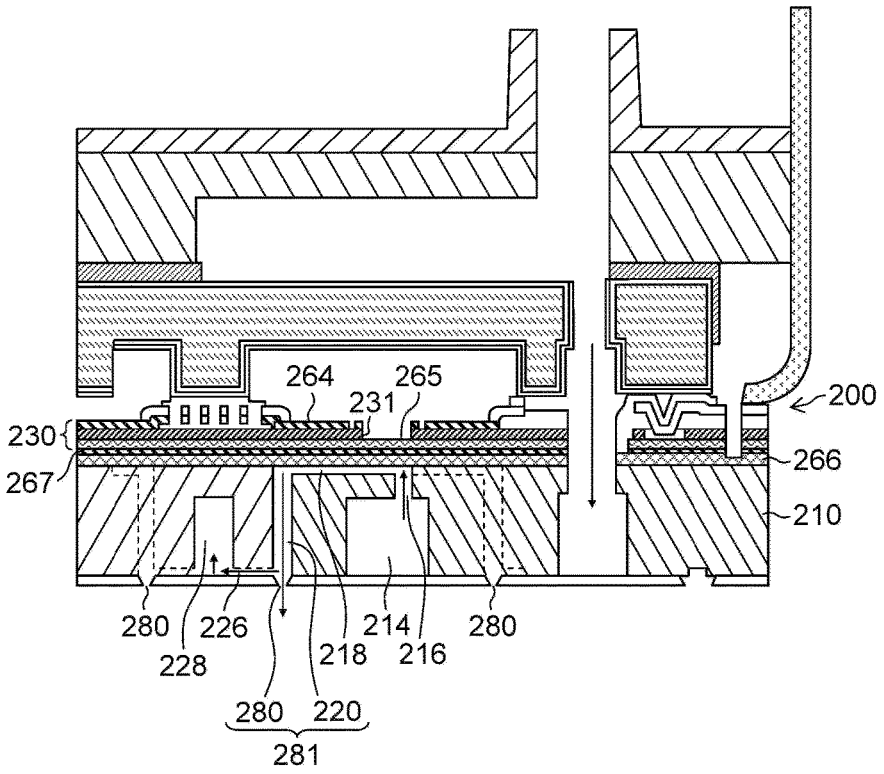
FIG. 4 is a cross-section view showing an internal structure of the head module.

The ink-jet head 21 shown in FIG. 1 is a line-type ink-jet head in which a plurality of nozzle parts are arranged over a length equal to or greater than the total length $L_{max}$ of the medium 100 in the width direction of the medium 100. The nozzle part, which is not illustrated in FIG. 1, is illustrated in FIG. 4 while reference numeral 281 is assigned.

An identical structure can be applied to the plurality of head modules 200 constituting the ink-jet head 21. Further, the head module 200 can function alone, as the ink-jet head.

<Structure of Head Module>

Figure 2:
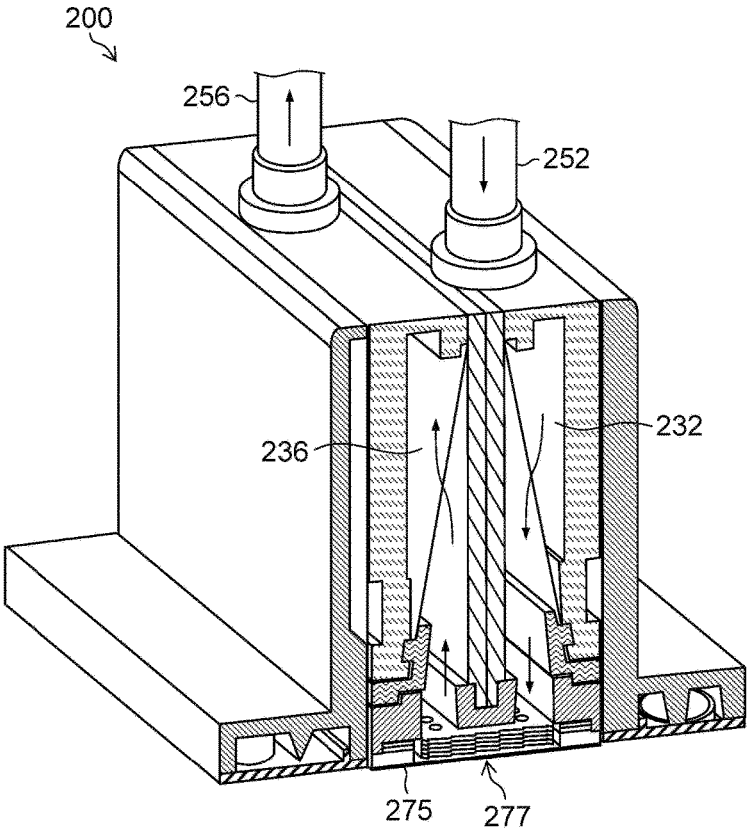
FIG. 2 is a perspective view of a head module, and is a diagram including a partial cross-section view.

FIG. 2 is a perspective view of a head module, and is a diagram including a partial cross-section view. Hereinafter, identical reference numerals are assigned to constituents identical to constituents that are previously described, and the descriptions are omitted when appropriate.

Ink in the specification is a mode of the liquid, and the term "ink" and the term "liquid" can be replaced when appropriate. Further, in the specification, the term "discharge" and the term "ejection" can be treated as synonymous terms, and the term "discharge" and the term "ejection" can be replaced when appropriate.

The head module 200 has an ink supply unit including an ink supply chamber 232, an ink circulation chamber 236 and the like, on the upper side in FIG. 2, which is the opposite side to a liquid ejection surface 277 of a nozzle plate 275.

The ink supply chamber 232 is connected with an ink tank not illustrated, through a supply-side individual passage 252, and the ink circulation chamber 236 is connected with a collection tank not illustrated, through a collection-side individual passage 256.

Figure 3:
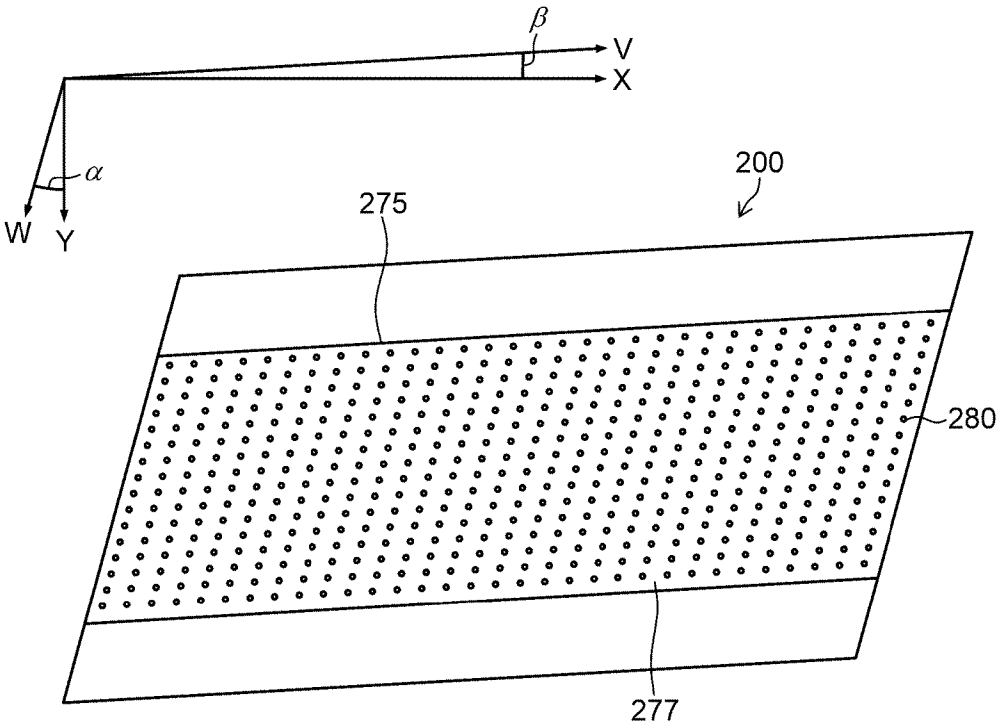
FIG. 3 is a perspective plan view of a liquid ejection surface of the head module.

FIG. 3 is a perspective plan view of the liquid ejection surface of the head module. In FIG. 3, nozzle openings 280 to be arranged on the liquid ejection surface 277 are illustrated so as to be reduced in number, but on the liquid ejection surface 277 of one head module 200, a plurality of nozzle openings 280 are arranged by a two-dimensional arrangement.

The head module 200 has a planar shape of a parallelogram that includes a long-side edge surface along a V-direction having a slope of an angle β with respect to the direction orthogonal to the medium feed direction and a short-side edge surface along a W-direction having a slope of an angle a with respect to the medium feed direction, and the plurality of nozzle openings 280 are arranged in a matrix, in a row direction along the V-direction and in a column direction along the W-direction.

The arrangement of the nozzle openings 280 is not limited to the mode illustrated in FIG. 3, and the plurality of nozzle openings 280 may be arranged in a row direction along the direction orthogonal to the medium feed direction and in a column direction crossing obliquely with respect to the direction orthogonal to the medium feed direction.

The matrix arrangement of the nozzle openings 280 is an arrangement of the nozzle openings 280 in which the arrangement intervals of the nozzle openings 280 are uniform on a projected nozzle array in the direction orthogonal to the medium feed direction, which is an array resulting from projecting the plurality of nozzle openings 280 in the direction orthogonal to the medium feed direction and arranging the plurality of nozzle openings 280 along the direction orthogonal to the medium feed direction.

FIG. 4 is a cross-section view showing an internal structure of the ink-jet head. Reference numeral 214 designates an ink supply path, reference numeral 218 designates a pressure chamber, reference numeral 216 designates an individual supply path that connects each pressure chamber 218 and the ink supply path 214, reference numeral 220 designates a nozzle communication path that is connected from the pressure chamber 218 to the nozzle opening 280, and reference numeral 226 designates a circulation individual passage that connects the nozzle communication path 220 and a circulation common passage 228. The pressure chamber 218 is sometimes referred to as a liquid chamber.

A vibration plate 266 is provided on a passage structure body 210 that configures the ink supply path 214, the individual supply path 216, the pressure chamber 218, the nozzle communication path 220, the circulation individual passage 226 and the circulation common passage 228. A piezoelectric element 230 having a laminate structure of a lower electrode 265, a piezoelectric substance layer 231 and an upper electrode 264 is provided on the vibration plate 266, through an adhesion layer 267. The lower electrode 265 is sometimes referred to as a common electrode, and the upper electrode 264 is sometimes referred to as an individual electrode.

The upper electrode 264 is an individual electrode that is patterned so as to correspond to the shape of each pressure chamber 218, and the piezoelectric element 230 is provided for each pressure chamber 218.

The ink supply path 214 is connected with the ink supply chamber 232 shown in FIG. 2, and the link is supplied from the ink supply path 214 through the individual supply path 216 to the pressure chamber 218. Depending on input image data, a drive voltage is applied to the upper electrode 264 of the piezoelectric element 230 provided on the corresponding pressure chamber 218. Thereby, the piezoelectric element 230 and the vibration plate 266 are transformed, and the volume of the pressure chamber 218 is changed. By a pressure change associated with this, the ink is discharged from the nozzle opening 280 through the nozzle communication path 220.

It is possible to discharge the ink from the nozzle opening 280, by controlling the drive of the piezoelectric element 230 corresponding to each nozzle opening 280, depending on dot arrangement data that is generated from the input image data.

While the medium 100 is fed at a constant speed in the medium feed direction, the timing of the ink discharge from each nozzle opening 280 is controlled in concert with the feed speed, and thereby, it is possible to record a desired image on the medium 100.

In the pressure chamber 218 provided so as to correspond to each nozzle opening 280, the planar shape is a roughly square shape. At one of both corner parts on a diagonal line, an outlet to the nozzle opening 280 is provided, and at the other, the individual supply path 216, which is an inlet of the supply ink, is provided. The illustration of the planar shape of the pressure chamber 218 is omitted.

Here, the planar shape of the pressure chamber is not limited to a square shape. As the planar shape of the pressure chamber, various shapes, as exemplified by a polygon such as a tetragon including a rhombus and a rectangle, a pentagon and a hexagon, a circle and an ellipse, are possible.

In the nozzle part 281 including the nozzle opening 280 and the nozzle communication path 220, a circulation outlet is formed, and the nozzle part 281 is communicated with the circulation individual passage 226 through the circulation outlet. The ink that is of the ink in the nozzle communication path 220 and the nozzle opening 280 and that is not used for discharge is collected to the circulation common passage 228 through the circulation individual passage 226.

The circulation common passage 228 is connected with the ink circulation chamber 236 shown in FIG. 2, and at all times, the ink is collected to the circulation common passage 228 through the circulation individual passage 226, resulting in the prevention of the thickening of the ink near the nozzle opening 280 when the discharge is not performed.

As a mode of the ejection element included in the head module, there is a mode of including one nozzle part 281, a passage such as the pressure chamber 218 communicated with the one nozzle part 281, and the piezoelectric element 230 corresponding to the nozzle part 281.

Hereinafter, the term "nozzle opening" and the term "nozzle part" in the specification can be replaced with "ejection element", when appropriate. Further, the term "nozzle opening" can be replaced with the term "nozzle part", when appropriate.

Examples of the piezoelectric element 230 include a piezoelectric element 230 having a structure of being individually separated so as to correspond to the nozzle opening 280 shown in FIG. 3. Needless to say, it is allowable to apply a structure in which the piezoelectric substance layer 231 is integrally formed for the plurality of nozzle parts 281, the individual electrode is formed so as to correspond to each nozzle part 281 and an active region is formed for each nozzle part 281.

It is allowable to apply a thermal system in which a heater is included within the pressure chamber 218 as a pressure generation element instead of the piezoelectric element, a drive voltage is supplied to the heater for heat generation and the ink in the pressure chamber 218 is discharged from the nozzle opening 280 by utilizing the film boiling phenomenon.

<Support Structure for Head Module>

Figure 5:
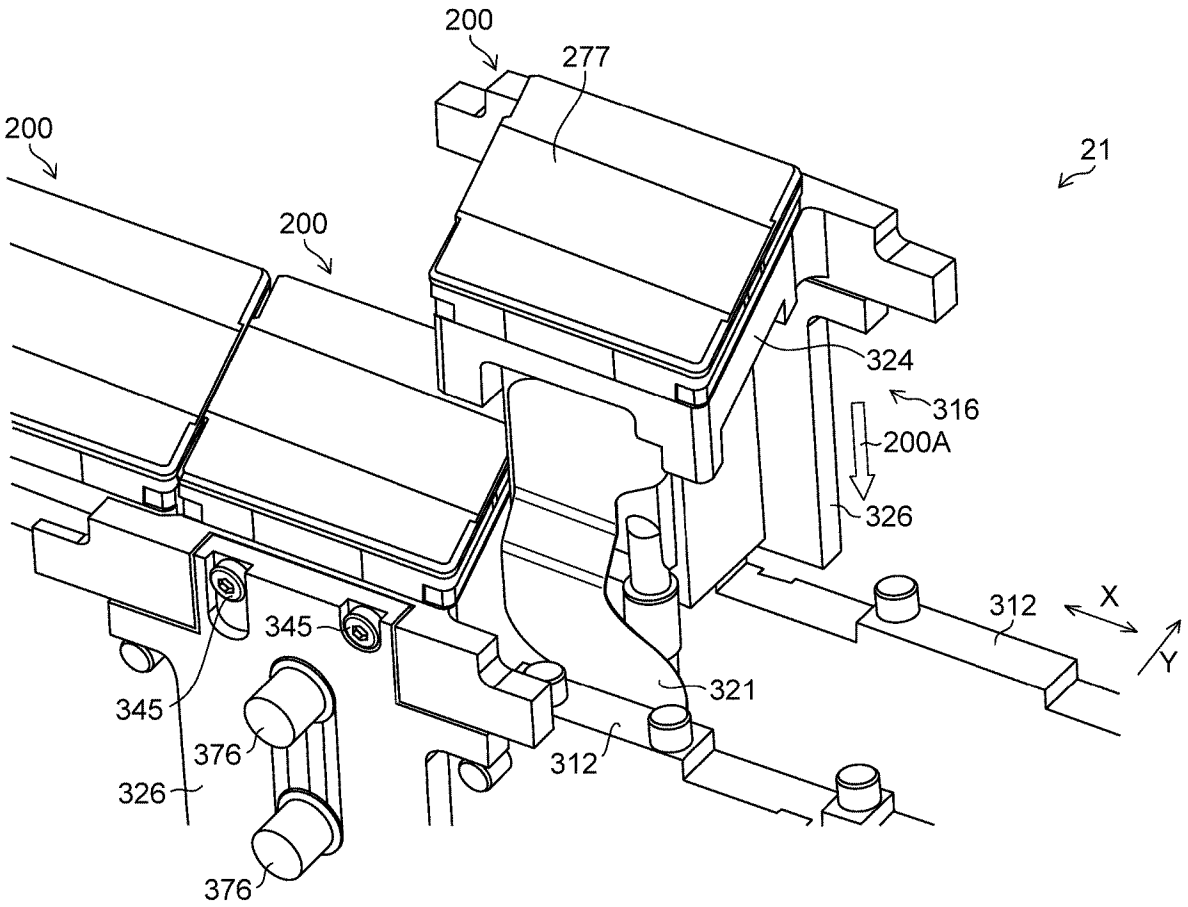
FIG. 5 is a perspective view showing a support structure for the head module.

FIG. 5 is a perspective view showing a support structure for the head module. FIG. 5 is a partial enlarged view of the ink-jet head 21, and is a diagram when the head module 200 is viewed from the side of the liquid ejection surface 277.

In FIG. 5, the direction shown while reference character X is assigned is the longitudinal direction of the ink-jet head 21. The longitudinal direction of the ink-jet head 21 is the width direction of the medium in a state in which the ink-jet head 21 is used while the ink-jet head 21 shown in FIG. 1 is mounted on the ink-jet recording apparatus.

Further, in FIG. 5, the direction shown while reference character Y is assigned is the short direction of the ink-jet head 21. The short direction of the ink-jet head 21 is the feed direction of the medium in a state in which the ink-jet head 21 is used while the ink-jet head 21 shown in FIG. 1 is mounted on the ink-jet recording apparatus.

In the specification, the "longitudinal direction of the ink-jet head 21" and the "width direction of the medium" can be replaced with each other. Similarly, the "short direction of the ink-jet head 21" and the "feed direction of the medium" can be replaced with each other.

Hereinafter, the longitudinal direction of the ink-jet head 21 is sometimes described as the X-direction. The short direction of the ink-jet head is sometimes described as the Y-direction.

FIG. 5 illustrates a state in which one of the plurality of head modules 200 attached to base frames 312 has been detached from the base frames 312. The arrow to which reference character 200A is assigned in FIG. 5 shows the attaching direction of the head module 200 to the base frames 312.

As shown in FIG. 5, the head module 200 is attached to a bracket 316. The bracket 316 includes a head module support part 324 that supports the head module 200, and a base frame support part 326 that is joined to one edge of the head module support part 324. The head module support part 324 is attached to the base frame support part 326, using two screws 345.

On the bracket 316, an X-direction adjustment part and a Y-direction adjustment part, which are not illustrated, are provided. The X-direction adjustment part has a structure for adjusting the relative position in the X-direction between an arbitrary head module 200 and a different head module 200 arranged at a position adjacent to the arbitrary head module 200.

The Y-direction adjustment part has a structure for adjusting the relative position in the Y-direction between an arbitrary head module 200 and a different head module 200 arranged at a position adjacent to the arbitrary head module 200.

As shown in FIG. 5, the head modules 200 attached to the base frames 312 include head modules 200 in each of which the base frame support part 326 is attached to one side of the head module 200 in the Y-direction and head modules 200 in each of which the base frame support part 326 is attached to the other side of the head module 200 in the Y-direction.

The ink-jet head 21 has a structure of alternately arranging the head modules 200 in each of which the base frame support part 326 is attached to one side of the head module 200 in the Y-direction and the head modules 200 in each of which the base frame support part 326 is attached to the other side of the head module 200 in the Y-direction.

A guide post 376 functions as a device that fixes the head module 200 attached to the bracket 316, on the base frames 312, and functions as a device that urges the head module 200 attached to the bracket 316, in the Y-direction.

A flexible substrate 321 to be connected with an electric wire of the head module 200 passes through the interval between the two facing base frames 312, and is connected with a drive circuit substrate on the opposite side to the liquid ejection surface 277 of the head module 200. The illustration of the drive circuit substrate is omitted.

The support structure for the head module 200 in the ink-jet head 21 shown in FIG. 5 is an example, and another support structure may be applied.

<Description of Joint Part>

Figure 6:
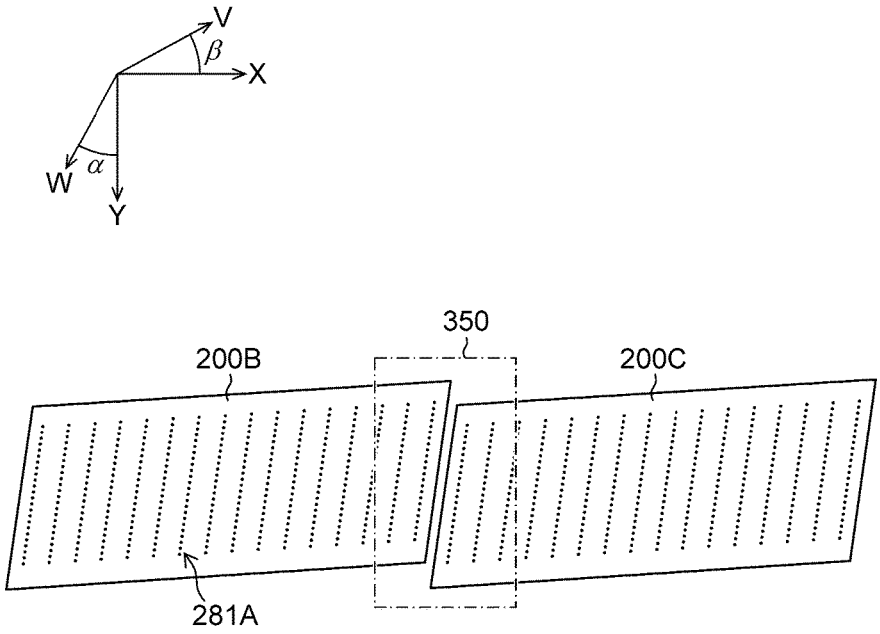
FIG. 6 is a conceptual diagram of a joint part.
Figure 7:
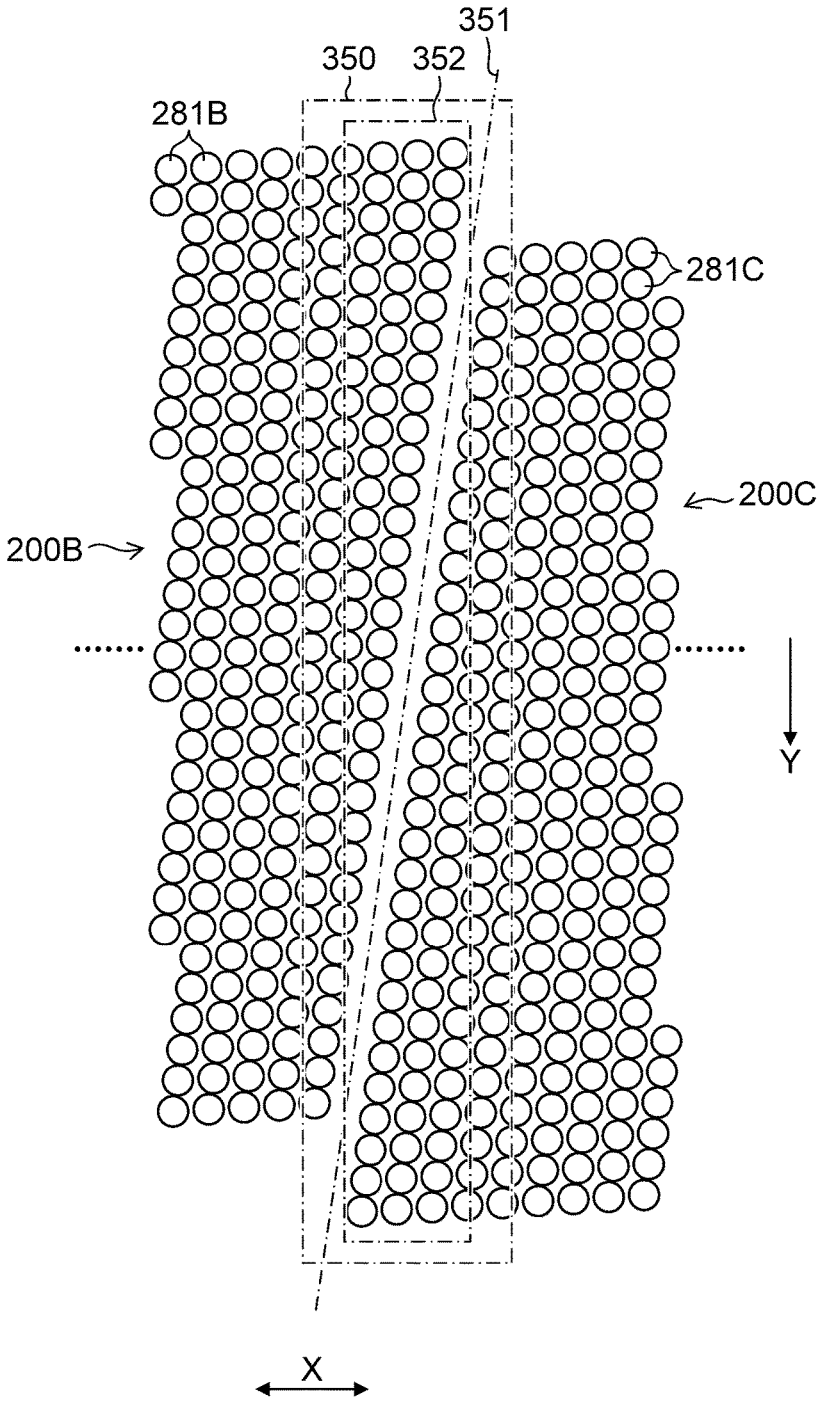
FIG. 7 is a partial enlarged view of FIG. 6.

FIG. 6 is a conceptual diagram of a joint part. FIG. 7 is a partial enlarged view of FIG. 6. FIG. 6 and FIG. 7 are perspective plan views of the liquid ejection surface 277, similarly to FIG. 3. FIG. 6 does not illustrate the nozzle parts 281 shown in FIG. 4 individually, and schematically illustrates, by dotted lines, nozzle arrays 281A each of which is constituted by a plurality of nozzle parts along the column direction shown in FIG. 3 while reference character W is assigned.

FIG. 6 and FIG. 7 show only two head modules of the plurality of head modules 200 shown in FIG. 1. In the two head modules shown in FIG. 6 and FIG. 7, the head module on the left side in FIG. 6 is referred to as a first head module 200B, and the head module on the right side in FIG. 6 is referred to as a second head module 200C.

In FIG. 7, reference character 281B designates a nozzle part belonging to the first head module 200B. Reference character 281C designates a nozzle part belonging to the second head module 200C.

The first head module 200B and second head module 200C shown in FIG. 6 can be configured as follows.

The number of the nozzle parts that constitute a single nozzle array along the W-direction is 32, the number of the nozzle arrays along the V-direction is 64, and the print resolution in the X-direction is 1200 dots per inch. The numerical value showing the print resolution shows the number of nozzle parts per 1 inch.

Here, 1 inch is 25.4 millimeters. The print resolution shown as the number of dots per 1 inch can be converted into the number of dots per 1 millimeter, by being divided by 25.4.

The inverse number of the number of dots per 1 millimeter is the inter-dot pitch. That is, when a print resolution of 1200 dots per inch is converted into inter-dot pitch, the value rounded to the first decimal place is 21.2 micrometers.

As a configuration example of a joint part 350 shown in FIG. 6 and FIG. 7, there is a mode in which 128 nozzle parts are included and the length in the X-direction is 2.5 millimeters.

In FIG. 6 and FIG. 7, the region surrounded by a dashed line is the joint part 350. The joint part 350 is a part that contains a position of the mechanical connection between the first head module 200B and the second head module 200C and that has a previously decided X-directional length.

In FIG. 6, the illustration of the position of the mechanical connection between the first head module 200B and the second head module 200C is omitted. The position of the mechanical connection between the first head module 200B and the second head module 200C is illustrated by a dashed line in FIG. 7, while reference numeral 351 is assigned.

At the joint part 350 shown in FIG. 7, there is a nozzle combining region 352. The nozzle combining region 352 is a region where the print resolution of the ink-jet head 21 is actualized while nozzle parts 281 B belonging to the first head module 200B and nozzle parts 281C belonging to the second head module 200C are combined.

Here, in the case where the nozzle parts are arranged in a matrix, the shape of the joint part 350 shown in FIG. 6 and FIG. 7 is complex, and therefore, the joint part 350 shown in FIG. 6 and FIG. 7 is simplified to the extent that the concept of the joint part 350 can be understood. Similarly, the nozzle combining region 352 shown in FIG. 7 is also simplified to the extent that the concept of the nozzle combining region 352 can be understood.

Figure 8:
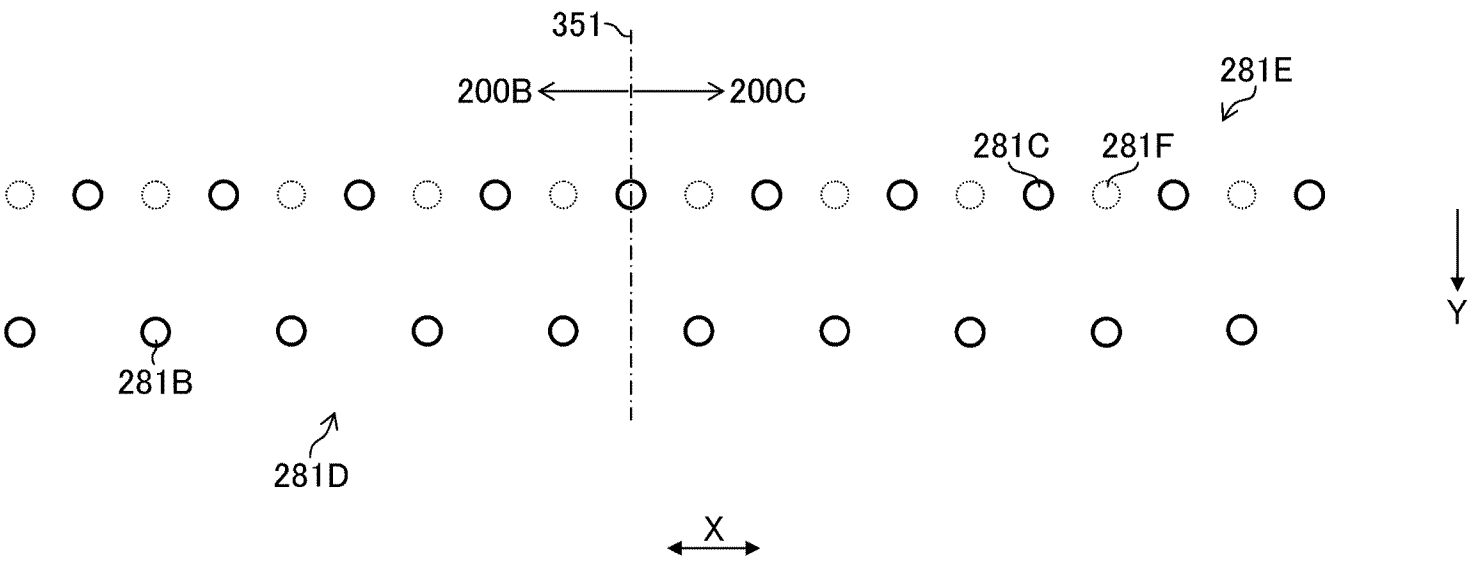
FIG. 8 is an explanatory diagram schematically showing an arrangement of nozzle parts at a nozzle combining region.

FIG. 8 is an explanatory diagram schematically showing an arrangement of nozzle parts at the nozzle combining region. A projected nozzle array 281D shown on the lower row in FIG. 8 includes nozzle parts 281B belonging to the first head module 200B shown in FIG. 6 and FIG. 7, and has an arrangement of the nozzle parts 281B that results from projecting the nozzle parts 281B arranged at the nozzle combining region 352 in the X-direction and arranging them along the X-direction.

Further, a projected nozzle array 281E shown on the upper row in FIG. 8 includes nozzle parts 281C belonging to the second head module 200C shown in FIG. 6 and FIG. 7, and has an arrangement of the nozzle parts 281C that results from projecting the nozzle parts 281C arranged at the nozzle combining region 352 in the X-direction and arranging them along the X-direction.

In the case where there is no error in the relative position between the first head module 200B and second head module 200C shown in FIG. 6 and FIG. 7 and where the first head module 200B and the second head module 200C are arranged at the theoretical positions, the X-directional positions of the nozzle parts 281B belonging to the projected nozzle array 281D, as shown in FIG. 8, coincide with the X-directional position of the nozzle parts 281C belonging to the projected nozzle array 281E, at the nozzle combining region 352 shown in FIG. 7.

Nozzle parts 281F illustrated in FIG. 8 by using the dotted lines are the nozzle parts belonging to the projected nozzle array 281D in the case where there is no error in the relative position between the first head module 200B and the second head module 200C and where the first head module 200B and the second head module 200C are arranged.

Meanwhile, there is an error in position between the first head module 200B and the second head module 200C, and therefore, there is a deviation between the X-directional positions of the nozzle parts 281B belonging to the projected nozzle array 281D and the X-directional positions of the nozzle parts 281C belonging to the projected nozzle array 281E.

FIG. 8 illustrates the nozzle parts 281C belonging to the projected nozzle array 281E in the case where the error in the relative position between the first head module 200B and second head module 200C shown in FIG. 6 and FIG. 7 is maximized.

Therefore, by performing the printing while appropriately selecting the nozzle parts 281B belonging to the first head module 200B and the nozzle parts 281C belonging to the second head module 200C at the joint part 350, the resolution of the ink-jet head 21 is actualized at the joint part 350 also.

Figure 9:
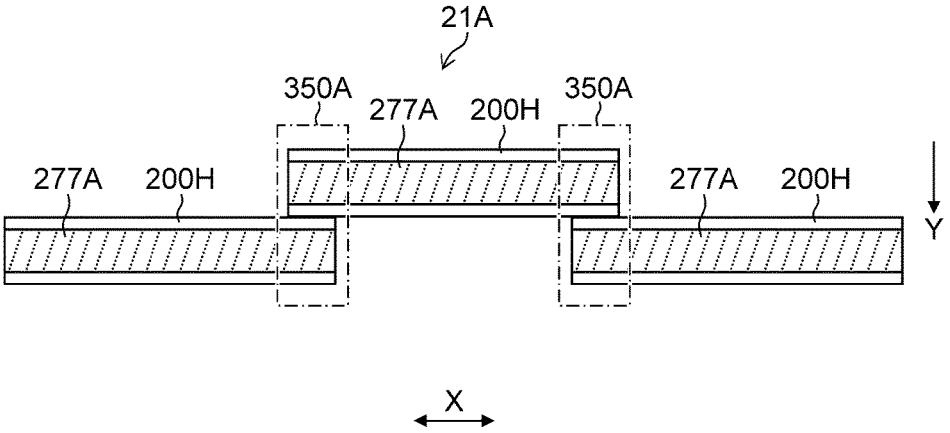
FIG. 9 is an explanatory diagram showing an alternative example of the joint part.
Figure 10:
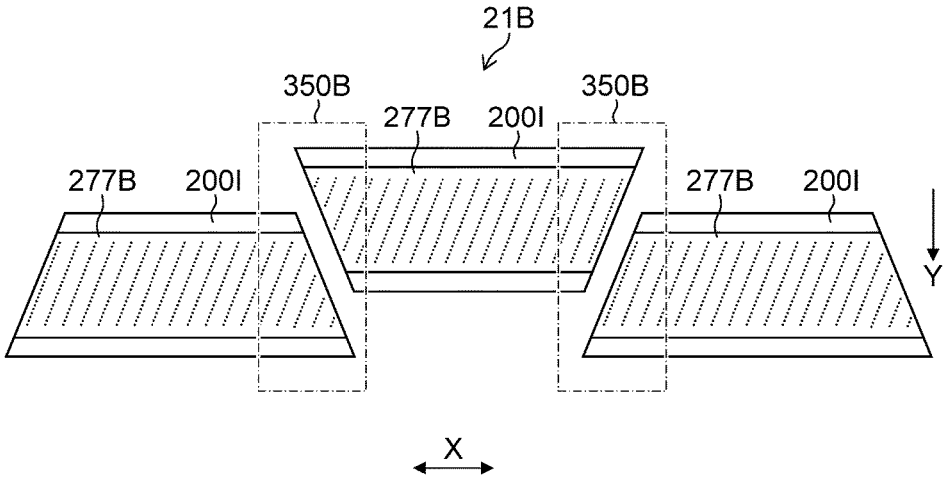
FIG. 10 is a perspective plan view of a liquid ejection surface that shows a further alternative example of the joint part.

FIG. 9 is a perspective plan view of a liquid ejection surface showing an alternative example of the joint part. FIG. 10 is a perspective plan view of a liquid ejection surface showing a further alternative example of the joint part.

In an ink-jet head 21A shown in FIG. 9, the planar shape of a surface containing a liquid ejection surface 277A of a head module 200H and the planar shape of the liquid ejection surface 277A are rectangles. The ink-jet head 21A shown in FIG. 9 is arranged such that the positions of the head modules 200H in the Y-direction are deviated alternately.

When the leftmost head module 200H of the three head modules 200H shown in FIG. 9 is the first head module 200B shown in FIG. 6 and FIG. 7, the central head module 200H in FIG. 9 is the second head module 200C shown in FIG. 6 and FIG. 7.

Further, when the central head module 200H in FIG. 9 is the first head module 200B shown in FIG. 6 and FIG. 7, the rightmost head module 200H in FIG. 9 is the second head module 200C shown in FIG. 6 and FIG. 7.

At joint parts 350A of the ink-jet head 21A shown in FIG. 9, there are nozzle combining regions.

In an ink-jet head 21B shown in FIG. 10, the planar shape of a surface containing a liquid ejection surface 277B of a head module 2001 and the planar shape of the liquid ejection surface 277B are trapezoids. The ink-jet head 21B shown in FIG. 10 is arranged such that the short sides and long sides of the surfaces containing the liquid ejection surfaces 277B of the head modules 200H are transposed alternately.

The correspondence relation between the three head modules 2001 shown in FIG. 10 and the first head module 200B and second head module 200C shown in FIG. 6 and FIG. 7 is identical to the correspondence relation between the three head modules 200H shown in FIG. 9 and the first head module 200B and second head module 200C shown in FIG. 6 and FIG. 7, and the description is omitted here.

Further, at joint parts 350B of the ink-jet head 21B shown in FIG. 10, there are nozzle combining regions.

Figure 11:
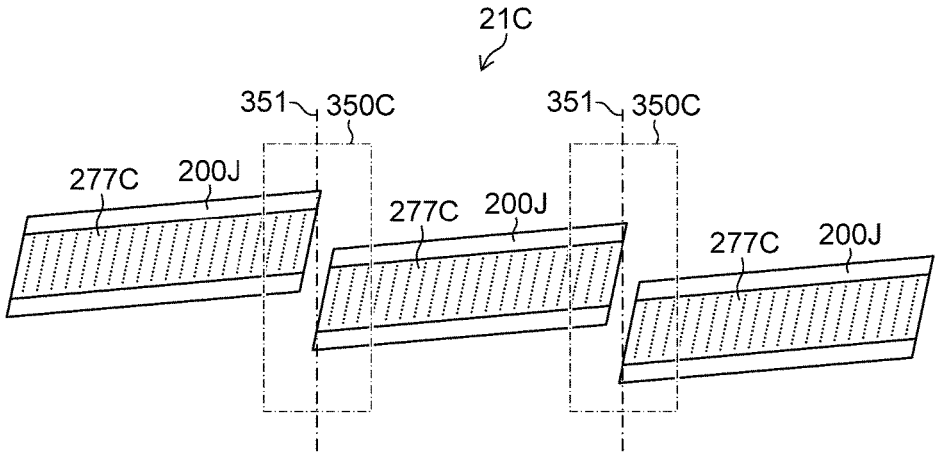
FIG. 11 is a perspective plan view of a liquid ejection surface that shows a further alternative example of the joint part.

FIG. 11 is a perspective plan view of a liquid ejection surface showing a further alternative example of the joint part. An ink-jet head 21C shown in FIG. 11 includes joint parts 350C at each of which there is no nozzle combining region 352 shown in FIG. 7.

In the ink-jet head 21C shown in FIG. 11, head modules 200J are arranged along the X-direction. In the ink-jet head 21C, the planar shape of a surface containing a liquid ejection surface 277C of the head module 200J and the planar shape of the liquid ejection surface 277C are parallelograms.

A joint part 350C shown in FIG. 11, in the X-direction, has a previously decided length from a connection position 351 between one of adjacently arranged head modules 200J and the other of the head modules 200J.

The X-directional length of the joint part 350C at which there is no nozzle combining region is decided in consideration of the X-directional length of the joint part in the case where there is the nozzle combining region, and the print resolution.

As an example of the X-directional length of the joint part 350C at which there is no nozzle combining region, there is a mode in which the lengths from the connection position of the two adjacently arranged head modules to both sides in the X-direction are 1 millimeter in the case where the print resolution of each head module is 1200 dots per inch.

The correspondence between the head modules 200J of the ink-jet head 21C shown in FIG. 11 and the first head module 200B and second head module 200C shown in FIG. 6 and FIG. 7 is the same as the ink-jet head 21A shown in FIG. 9 and the ink-jet head 21B shown in FIG. 10, and the description is omitted here.

Figure 12:
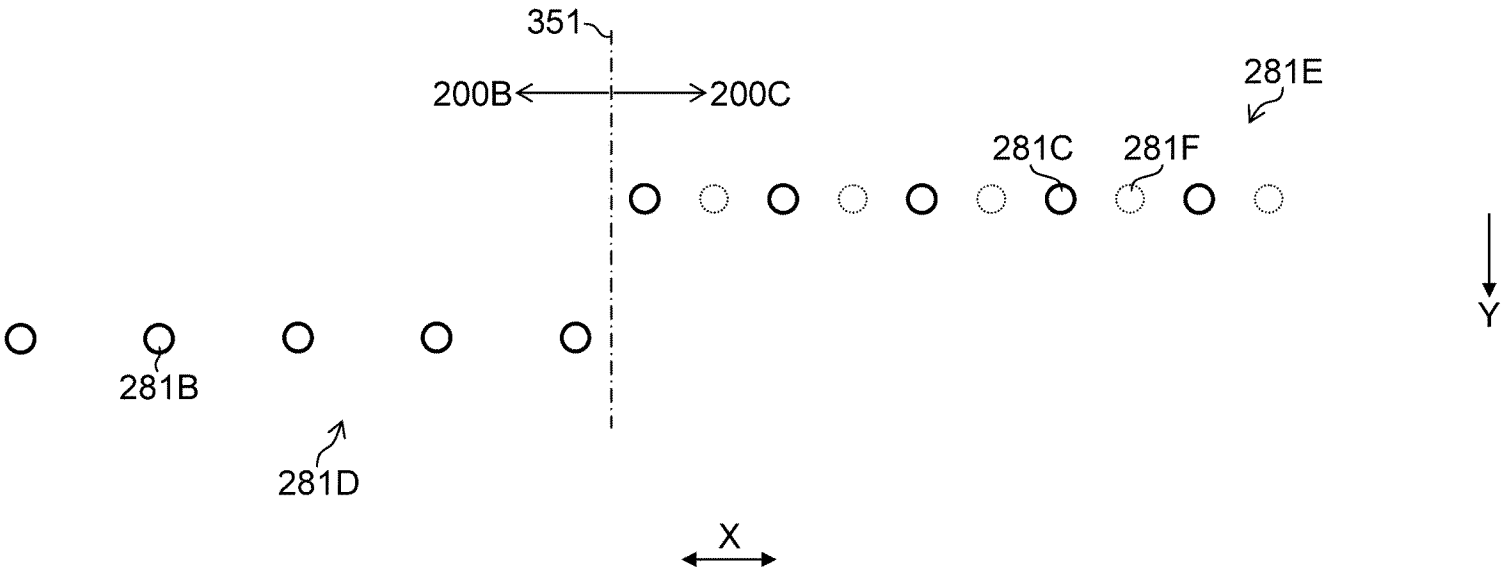
FIG. 12 is an explanatory diagram schematically showing an arrangement of nozzle parts at the joint part shown in FIG. 11.

FIG. 12 is an explanatory diagram schematically showing an arrangement of nozzle parts at the joint part shown in FIG. 11. Since there is no nozzle combining region at the joint part 350C shown in FIG. 11, the switching between the projected nozzle array 281D and the projected nozzle array 281E is performed at the connection position 351 between the first head module 200B and the second head module 200C, as shown in FIG. 12.

The joint parts 350 shown in FIG. 9 and FIG. 10 and the joint part 350C shown in FIG. 11 are examples. Although the arrangement of the nozzle parts at the joint part varies depending on the arrangement of the nozzle parts in head modules to be used, an ink-jet head production method according to the embodiment can be applied to any arrangement of the nozzle parts.

[Image Quality at Joint Part]

In an ink-jet head having a structure in which a plurality of head modules are arrayed, the deterioration in image quality is likely to appear, at the joint part between adjacently arranged head modules. As a cause for the deterioration in image quality at the joint part, there is a mechanical positional deviation when the head modules are attached. Further, as another cause, there is a lag in ejection timing between the head modules. Furthermore, there is a complex cause of them.

The study by the inventor of the present invention has revealed that the deterioration in image quality at the joint part appears in the case where the ejection volume of the nozzle part arranged at the joint part is less than a standard ejection volume of the head module.

Here, the ejection volume is the volume of unit liquid that is ejected from the nozzle part. The unit liquid is a liquid that forms one dot. As the mode in which the unit liquid is ejected, there is a mode in which all of the liquid that forms one dot is ejected by one ejection operation, or a mode in which all of the liquid that forms one dot is ejected by multiple ejection operations.

The above study for the ejection volume was performed for a droplet type that is highest in use frequency in the case of a high-definition printing. Examples of the high-definition printing include a printing in which the print resolution is 1200 dots per inch. Examples of the droplet type that is highest in use frequency in the case of the high-definition printing include a droplet type having the smallest volume that is used in printing. By the droplet having the smallest volume, a dot having the smallest size that is used in printing is formed.

[Description of Adjustment of Ejection Volume]

For the ink-jet head, there is decided an average ejection volume target value, which is a target value of an average ejection volume that is decided from a specification of the ink-jet recording apparatus. The average ejection volume is an average value of the ejection volumes of all nozzle parts.

In the ink-jet head having a structure in which the plurality of head modules are arrayed, the adjustment of the ejection volume for matching the actual average ejection volume for each head module with the ejection volume target value of the ink-jet head is performed for each head module.

Figure 13:
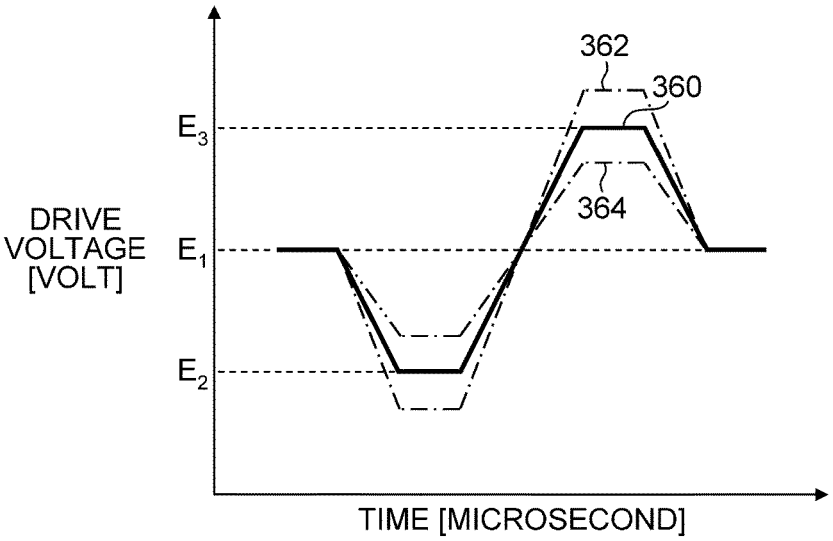
FIG. 13 is an explanatory diagram of amplification factor adjustment of drive voltage.

FIG. 13 is an explanatory diagram of the amplification factor adjustment of the drive voltage. The horizontal series in FIG. 13 indicates time, and the unit is microsecond. The "micro" is an auxiliary unit showing $10^{-6}$-fold. The vertical series in FIG. 13 indicates voltage, and the unit is volt.

A drive voltage 360 shown in FIG. 13 is a waveform of the drive voltage that is supplied to the piezoelectric element 230 when the ink is ejected from the nozzle part 281 shown in FIG. 4. The drive voltage 360 shown in FIG. 13 is a voltage for ejecting the ink in the droplet state from the nozzle opening 280 shown in FIG. 4, by transforming the piezoelectric element 230 shown in FIG. 4 to contract the pressure chamber 218, expanding the contracted pressure chamber 218 to push put the ink in the pressure chamber 218 from the nozzle opening 280, and restoring the expanded pressure chamber 218 to the former state to divide the ink pushed from the nozzle opening 280.

That is, the drive voltage 360 shown in FIG. 13 is a so-called pull-push waveform. A voltage $E_1$ of the drive voltage 360 is a voltage that is supplied to the piezoelectric element 230 when the piezoelectric element 230 shown in FIG. 4 is put into a static state.

A voltage $E_2$ of the drive voltage 360 shown in FIG. 13 is a voltage that is supplied to the piezoelectric element 230 when the pressure chamber 218 is put into the contracted state by transforming the piezoelectric element 230 shown in FIG. 4.

A voltage $E_3$ of the drive voltage 360 shown in FIG. 13 is a voltage that is supplied to the piezoelectric element 230 when the pressure chamber 218 is put into the expanded state by transforming the piezoelectric element 230 shown in FIG. 4.

By changing the waveform of the drive voltage 360 shown in FIG. 13, it is possible to adjust the ejection voltage of the ink that is ejected from the nozzle part.

There is an individual difference in the ejection performance of the head module, and even when an identical drive voltage is supplied, there is a possibility that in some head modules, the actual ejection volumes are less than the target value of the ejection volume, and in some head modules, the actual ejection volumes are greater than the target value of the ejection voltage.

Hence, the drive voltage is adjusted for each head module, and the actual ejection volumes of all head modules are adjusted to the target value of the ejection volume of the ink-jet head.

A drive voltage 362 shown in FIG. 13 is a drive voltage that is applied to a head module in which the average ejection volume is less than the average ejection volume target value, and has a waveform resulting from multiplying the waveform of the drive voltage 360 by an amplification factor exceeding 1.

A drive voltage 364 shown in FIG. 13 is a drive voltage that is applied to a head module in which the average ejection volume exceeds the average ejection volume target value, and has a waveform resulting from multiplying the waveform of the drive voltage 360 by an amplification factor exceeding 0 and being less than 1.

Figure 14:
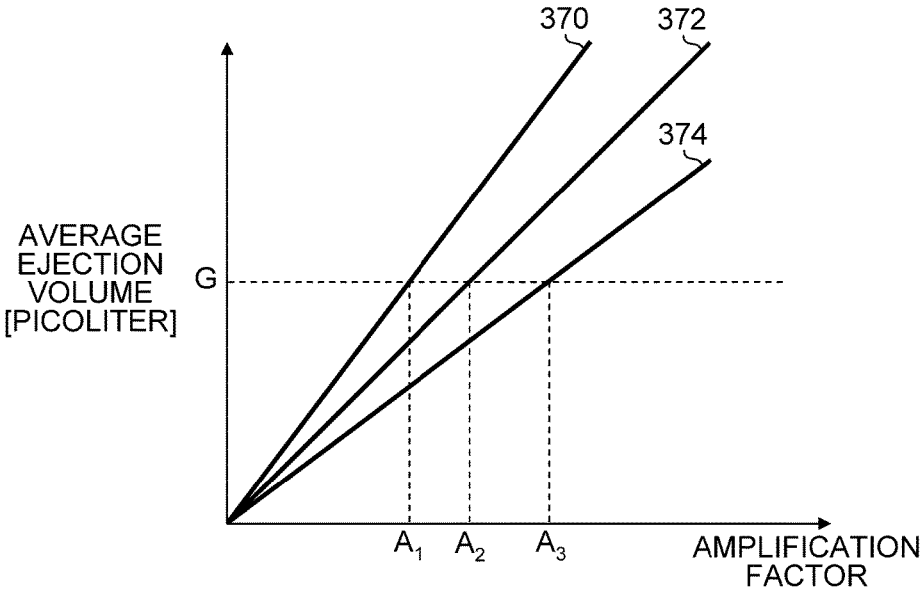
FIG. 14 is an explanatory diagram of the amplification factor of the drive voltage.

FIG. 14 is an explanatory diagram of the amplification factor of the drive voltage. The horizontal series in FIG. 14 indicates the amplification factor of the drive voltage. The vertical series in FIG. 14 indicates the average ejection volume for each head module, and the unit is picoliter. The average ejection volume of the head module is an average value of the ejection volumes of all nozzle parts that are included in the head module, and is calculated by dividing the total sum of the ejection volumes of the nozzle parts by the total number of the nozzle parts. Reference character G shown in FIG. 14 designates the target value of the ejection volume that is applied to the ink-jet head.

To a head module having an ejection characteristic to which reference numeral 370 is assigned in FIG. 14, $A_1$ is applied as the amplification factor of the drive voltage. To a head module having an ejection characteristic to which reference numeral 372 is assigned, $A_2$ is applied as the amplification factor of the drive voltage. To a head module having an ejection characteristic to which reference numeral 374 is assigned, $A_3$ is applied as the amplification factor of the drive voltage.

In this way, the amplification factor of the drive voltage is decided for each head module, and the drive voltage is adjusted for each head module. Thereby, the average ejection volumes of all head modules constituting the ink-jet head are adjusted to the average ejection volume target value that is applied to the ink-jet head.

[Description of Ejection Volume Distribution]

Generally, the head module has a distribution of the ejection volume, in the longitudinal direction of the ink-jet head. FIG. 15 to FIG. 22 are explanatory diagrams of the ejection volume distribution of the head module.

The horizontal series in FIG. 15 to FIG. 22 indicates nozzle numbers. The nozzle numbers are consecutive numbers that are assigned in order from a number-1 nozzle part to a number-M nozzle part, where the number-1 nozzle part is the nozzle part at one end or the other end of a projected nozzle array that is an array resulting from projecting the plurality of nozzle parts provided in the head module in the longitudinal direction of the ink-jet head and arranging them along the longitudinal direction of the ink-jet head, and the number-M nozzle part is the nozzle part at the opposite end to the number-1 nozzle part.

In the embodiment, the number-1 nozzle is arranged at the end on the left side in FIG. 1 and FIG. 3, and the number-M nozzle is arranged at the end on the right side. Then, the end where the number-1 nozzle is arranged is the end on the negative side in the longitudinal direction of the ink-jet head, and the end where the number-M nozzle is arranged is the end on the positive side in the longitudinal direction of the ink-jet head.

The end on the negative side of the head module in the embodiment corresponds to one end of the head module, and the end on the positive side of the head module in the embodiment corresponds to the other end of the head module.

The vertical series in FIG. 15 to FIG. 22 indicates the ejection volume for each nozzle part. The unit of the vertical series is picoliter. The prefix "pico" is an auxiliary unit showing $10^{-12}$-fold. The ejection volume of the nozzle part whose nozzle number is 1 is $V_1$, and the ejection volume of the nozzle part whose nozzle number is M is $V_M$.

Figure 15:
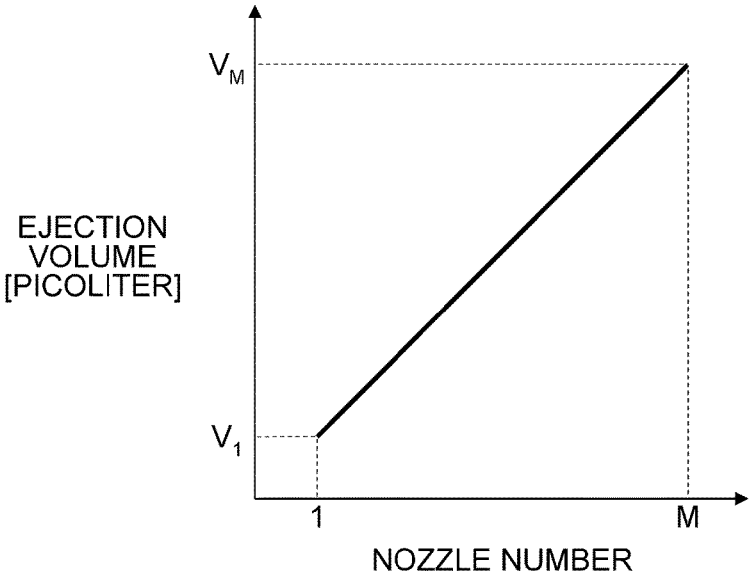
FIG. 15 is an explanatory diagram of an ejection volume distribution of the head module.
Figure 16:
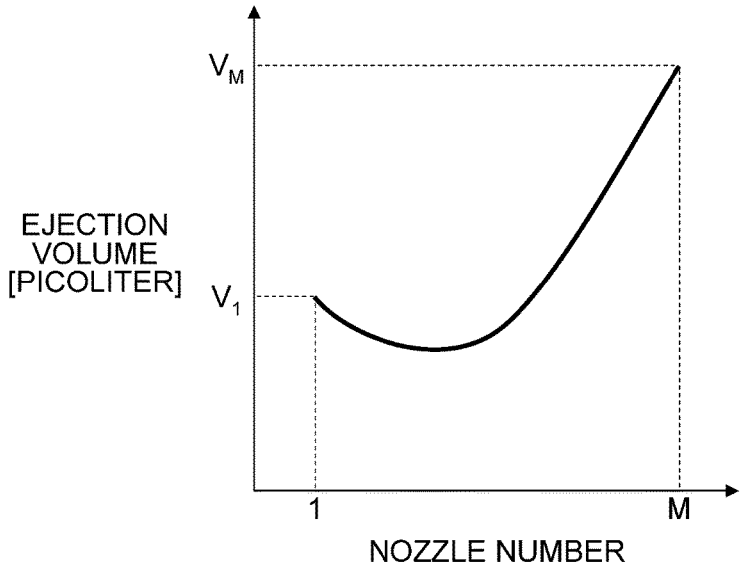
FIG. 16 is an explanatory diagram of an ejection volume distribution of the head module.
Figure 17:
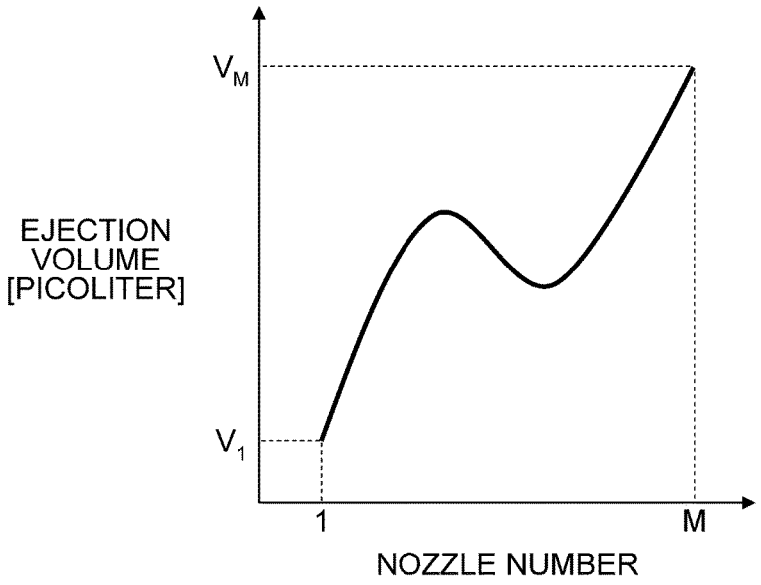
FIG. 17 is an explanatory diagram of an ejection volume distribution of the head module.

The ejection volume distributions of the head module shown in FIG. 15 to FIG. 17 are ejection volume distributions when the slope is positive. The slope of the ejection volume distribution of the head module is expressed as $(V_M-V_1)/(M-1)$, by using the ejection volume $V_1$ of the nozzle part whose nozzle number is 1, the ejection volume $V_M$ of the nozzle part whose nozzle number is M, and the total number M of the nozzle parts.

The slope of the ejection volume distribution of the head module is defined as being positive in the case of $V_M-V_1>0$, that is, $M>V_1$.

Figure 18:
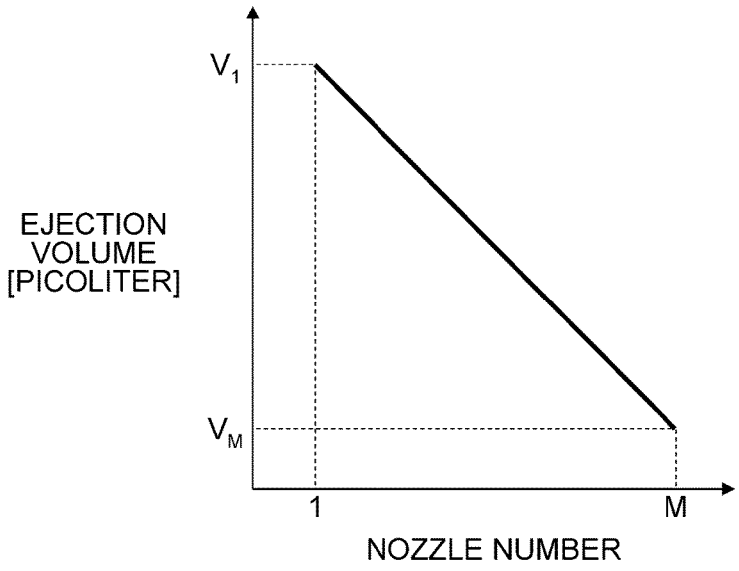
FIG. 18 is an explanatory diagram of an ejection volume distribution of the head module.
Figure 19:
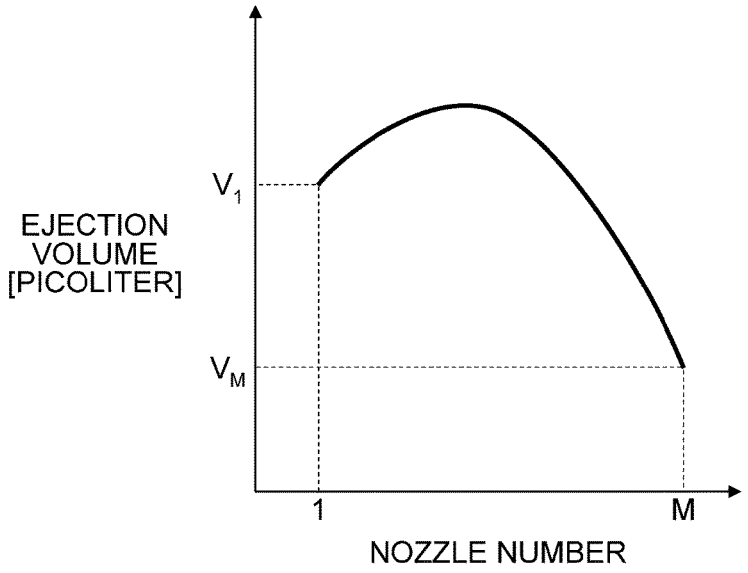
FIG. 19 is an explanatory diagram of an ejection volume distribution of the head module.
Figure 20:
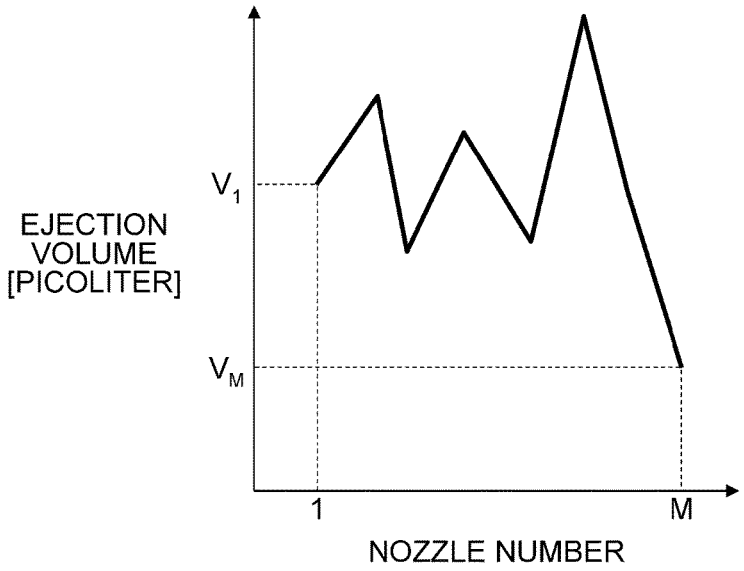
FIG. 20 is an explanatory diagram of an ejection volume distribution of the head module.

The ejection volume distributions of the head module shown in FIG. 18 to FIG. 20 are ejection volume distributions when the slope is negative. The slope of the ejection volume distribution of the head module is defined as being negative in the case of $V_M-V_1<0$, that is, $V_M<V_1$.

Figure 21:
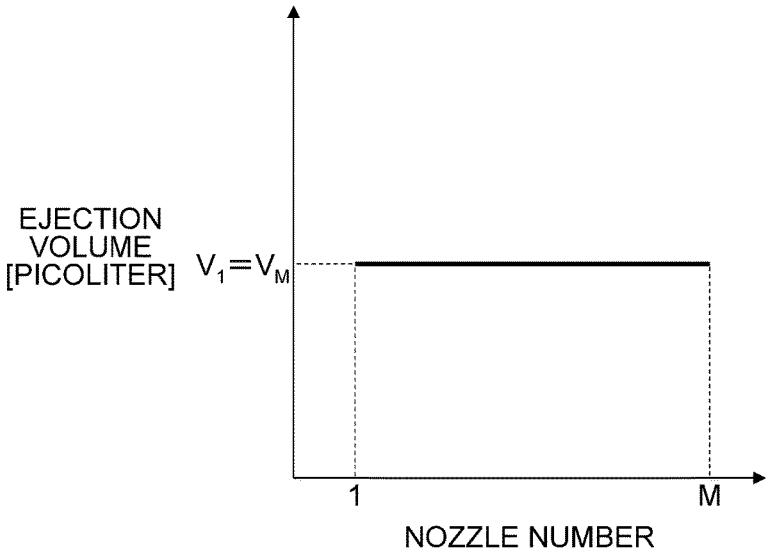
FIG. 21 is an explanatory diagram of an ejection volume distribution of the head module.
Figure 22:
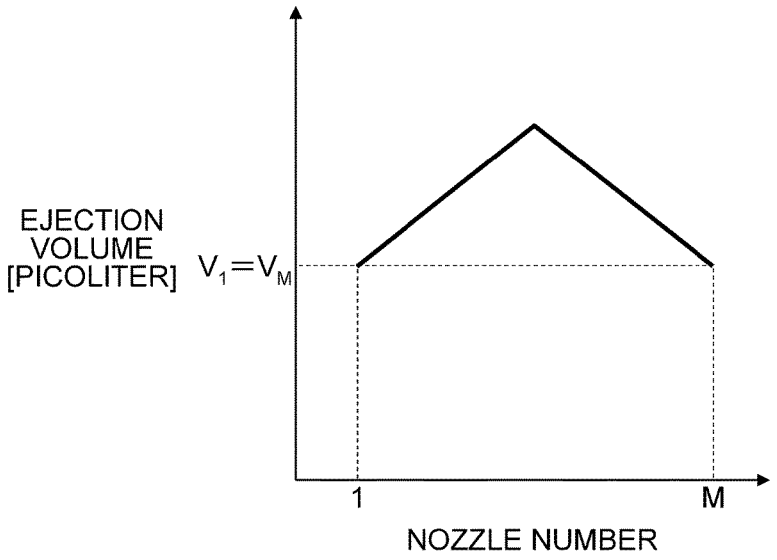
FIG. 22 is an explanatory diagram of an ejection volume distribution of the head module.

The ejection volume distributions of the head module shown in FIG. 21 and FIG. 22 are ejection volume distributions when the slope is zero. The slope of the ejection volume distribution of the head module is defined as zero in the case of $V_M-V_1=0$, that is, $V_M=V_1$.

In the embodiment, the slope of the ejection volume distribution is defined using the ejection volume of the nozzle part that is the nozzle part at one end of the head module and whose nozzle number is 1 and the ejection volume of the nozzle part that is the nozzle part at the other end of the head module and whose nozzle number is M. However, the slope of the ejection volume distribution may be defined, for example, using the ejection volume of ten nozzle parts ranging from the nozzle part whose nozzle number is 1 to the nozzle part whose nozzle number is 10 as the ejection volume of the nozzle part at one end part of the head module, and using the ejection volume of ten nozzle parts ranging from the nozzle part whose nozzle number is M-9 to the nozzle part whose nozzle number is M as the ejection volume of the nozzle part at the other end part of the head module.

In other words, the slope of the ejection volume distribution of the head module can be defined using the ejection volume of a single or a plurality of nozzle parts arranged at one end part of the head module and the ejection volume of a single or a plurality of nozzle parts arranged at the other end part of the head module on the projected nozzle array shown in FIG. 3.

Examples of the one end part of the head module and the other end part of the head module include regions where a plurality of nozzles parts to be arranged at both ends of the head module or at the joint parts are arranged.

In the case where the slope of the ejection volume distribution of each head module is defined using the ejection volume of a plurality of nozzles, a representative value such as average value, maximum value or minimum value can be used as the ejection volume of the plurality of nozzles. In the embodiment, the average value is used as the ejection volume of the plurality of nozzles.

In the embodiment, a mode in which the slope of the ejection volume distribution of each head module is derived as the difference in the ejection volume is exemplified, but the slope of the ejection volume distribution of each head module can be derived also as the ratio of the ejection volume. The slope of the ejection volume distribution of each head module may be derived by dividing the ejection volume of the nozzle part at the other end part of the head module by the ejection volume of the nozzle part at the one end part of the head module.

In the case where the slope of the ejection volume distribution of each head module is derived by dividing the ejection volume of the nozzle part at the other end part of the head module by the ejection volume of the nozzle part at the one end part of the head module, a slope of 0 or greater and less than 1 corresponds to a negative slope in the case where the slope of the ejection volume distribution of each head module is derived as the difference in the ejection volume, and a slope of 1 or greater can be treated as a positive slope in the case where the slope of the ejection volume distribution of each head module is derived as the difference in the ejection volume.

As shown in FIG. 15 to FIG. 22, the head module has a distribution of the ejection volume in the longitudinal direction of the ink-jet head, and therefore, at the joint part 350 shown in FIG. 6 and FIG. 7, there can be a difference between the ejection volume of the nozzle parts belonging to the first head module 200B and the ejection volume of the nozzle parts belonging to the second head module 200C, even when the average ejection volume of the each head module is adjusted to the average ejection volume target value of the ink-jet head.

Hence, as shown below, the arrangement of the head modules is set in consideration of the ejection volumes of the nozzle parts arranged at the joint parts among three head modules that are arranged at adjacent positions, and thereby, the deterioration in image quality at the joint parts is suppressed.

[Detailed Description of Structure of Ink-Jet Head]

<Overview>

Figure 23:
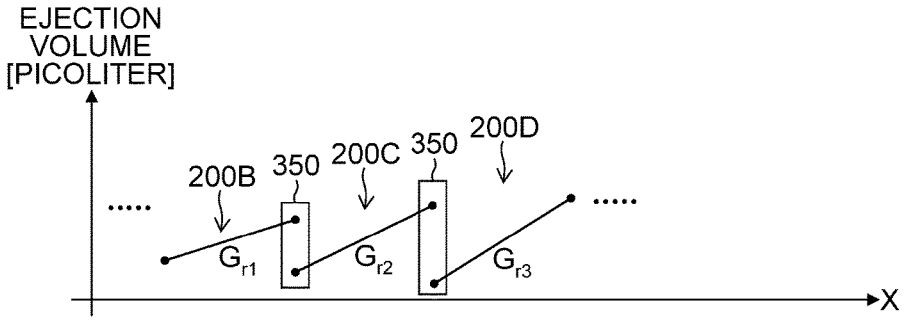
FIG. 23 is an explanatory diagram schematically showing a structure example of the ink-jet head.

FIG. 23 is an explanatory diagram schematically showing a structure example of the ink-jet head. FIG. 23 illustrates the relation of the ejection volume distributions of the first head module 200B, the second head module 200C and the third head module 200D, in the form of a graph.

The horizontal series in FIG. 23 indicates the position in the longitudinal direction of the ink-jet head. The vertical series in FIG. 23 indicates the ejection volume of the head module. In FIG. 23, similarly to FIG. 15 to FIG. 22, the nozzle number increases from left to right, and the head module number increases from left to right.

The first head module 200B, second head module 200C and third head module 200D shown in FIG. 23 are three head modules arranged at arrangement positions that are adjacent in the longitudinal direction of the ink-jet head. At each end of the first head module 200B, the second head module 200C and the third head module 200D, the joint part 350 is provided.

The longitudinal direction of the ink-jet head is a mode of the single direction. The single direction can be not only the direction from left to right in FIG. 23 but also the direction from right to left. In the following description, the direction from left to right in FIG. 23, that is, the direction of the increase in the head module number corresponds to the single direction.

The first head module 200B, second head module 200C and third head module 200D shown in FIG. 23 are arranged in order from the head module that is smallest in the slope of the ejection volume distribution. That is, the first head module 200B, the second head module 200C and the third head module 200D have such an arrangement that the slopes of the ejection volume distributions are in ascending order.

The slope $G_{r1}$ of the ejection volume distribution of the first head module 200B, the slope $G_{r2}$ of the ejection volume distribution of the second head module 200C and the slope $G_{r3}$ of the ejection volume distribution of the third head module 200D have a relation of $G_{r1} \leq G_{r2} \leq G_{r3}$. Further, in each of the first head module 200B, the second head module 200C and the third head module 200D, the slope of the ejection volume distribution is positive. Although the illustration is omitted, the slope $G_{r1}$ of the ejection volume distribution of the first head module 200B, the slope $G_{r2}$ of the ejection volume distribution of the second head module 200C and the slope $G_{r3}$ of the ejection volume distribution of the third head module 200D may have a relation of $G_{r1} \geq G_{r2} \geq G_{r3}$. That is, the first head module 200B, the second head module 200C and the third head module 200D may have a descending-order arrangement so as to be arrayed in order from the head module that is largest in the slope of the ejection volume distribution.

Further, in the first head module 200B, the second head module 200C and the third head module 200D, the slopes of the ejection volume distributions may be all negative.

Figure 24:
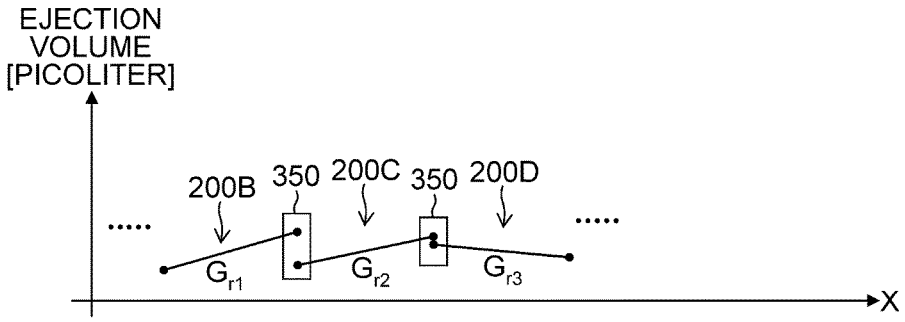
FIG. 24 is an explanatory diagram schematically showing an alternative structure example of the ink-jet head.

FIG. 24 is an explanatory diagram schematically showing an alternative structure example of the ink-jet head. In the alternative structure example of the ink-jet head shown in FIG. 24, head modules in which the slopes of the ejection volume distributions are positive and head modules in which the slopes of the ejection volume distributions are negative are mixed.

In the first head module 200B and second head module 200C shown in FIG. 24, the slopes of the ejection volume distributions are positive. In the third head module 200D, the slope of the ejection volume distribution is negative.

The first head module 200B, second head module 200C and third head module 200D shown in FIG. 24 have such an arrangement that the slopes of the ejection volume distributions are in descending order. Further, in the alternative structure example of the ink-jet head shown in FIG. 24, the positive/negative sign of the slope of the ejection volume distribution switches at one position between the second head module 200C and the third head module 200D.

Although the illustration is omitted, also in the case where the first head module 200B, the second head module 200C and the third head module 200D have such an arrangement that the slopes of the ejection volume distributions are in ascending order, the positive/negative sign of the slope of the ejection volume distribution switches at one position, when head modules in which the slopes of the ejection volume distributions are positive and head modules in which the slopes of the ejection volume distributions are negative are mixed.

Figure 25:
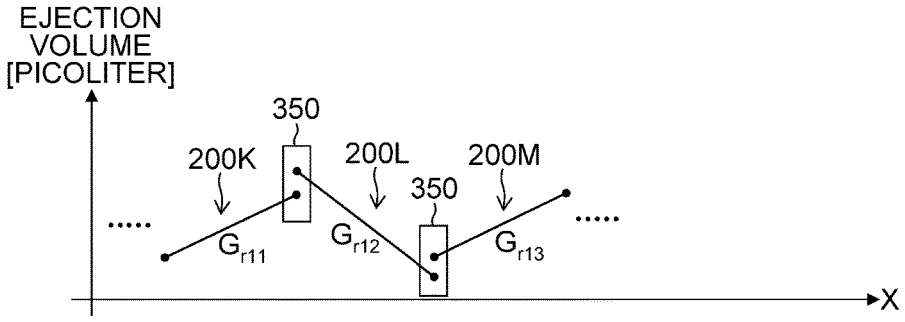
FIG. 25 is an explanatory diagram schematically showing a structure example of an ink-jet head according to a comparative example.

FIG. 25 is an explanatory diagram schematically showing a structure example of an ink-jet head according to a comparative example. When the slopes of the ejection volume distributions of a first head module 200K, second head module 200L and third head module 200M shown in FIG. 25 are $G_{r11}$, $G_{r12}$ and $G_{r13}$ respectively, $G_{r11} \geq G_{r12}$ and $G_{r12} \leq G_{r13}$ hold, and the first head module 200K, the second head module 200L and the third head module 200M have neither such an arrangement that the slopes of the ejection volume distributions are in ascending order nor such an arrangement that the slopes of the ejection volume distributions are in descending order.

Further, in the first head module 200K and the third head module 200M, the slopes of the ejection volume distributions are positive. In the second head module 200L, the slope of the ejection volume distribution is negative.

Furthermore, the positive/negative sign of the slope of the ejection volume distribution switches between the first head module 200K and the second head module 200L, and the positive/negative sign of the slope of the ejection volume distribution switches between the second head module 200L and the third head module 200M. That is, the first head module 200K, the second head module 200L and the third head module 200M have such an arrangement that the positive/negative sign of the slope of the ejection volume distribution switches at two positions.

In the ink-jet head according to the comparative example shown in FIG. 25, in some cases, the ejection volume at the joint part between the head modules becomes too small, or the ejection volume at the joint part between the head modules becomes too large, and there is a possibility of the occurrence of the deterioration in image quality at the joint part between the head modules.

On the other hand, when the three head modules arranged at the arrangement positions that are adjacent in the longitudinal direction of the ink-jet head have such an arrangement that the slopes of the ejection volume distributions are in ascending order or such an arrangement that the slopes of the ejection volume distributions are in descending order as shown in FIG. 23 and FIG. 24, it is possible to make the ejection volume at the joint part between the head modules close to the average of the ejection volume in the whole of the head module, and it is possible to suppress the decrease in the ejection volume at the joint part.

Further, when the slopes of the ejection volume distributions are all positive or all negative in the three head modules arranged at the arrangement positions that are adjacent in the longitudinal direction of the ink-jet head, it is possible to suppress the increase in the ejection volume, and it is possible to prevent the degradation in the graininess of printed images when the ink-jet head is used in the printing of images, which appears in the case where the ejection volume is too large.

In the embodiment, the ink-jet head including three head modules has been described, but the above head module arrangement can be applied to an ink-jet head having a structure in which three or more head modules are arranged along a single direction. When N is an integer of 3 or more, a mode in which the slopes of the ejection volume distributions of all N head modules are positive or negative, or a mode in which the slopes of the ejection volume distributions are in ascending order or in descending order is possible.

The arrangement of three or more head modules can be actualized by acquiring the slope of the ejection volume distribution for all head modules, executing a permutation process whose variable is the slope of the ejection volume distribution for the head modules, and deciding the arrangement of the head modules.

When each head module includes an ejection volume distribution slope storage unit in which the slope of the ejection volume distribution is stored, it is possible to acquire the slope of the ejection volume of each head module exactly and surely.

<Application Example When Positive and Negative of Slope of Ejection Volume Distribution Are Mixed>

In the case where head modules in which the slopes of the ejection volume distributions are positive and head modules in which the slopes of the ejection volume distributions are negative are mixed, it is preferable to be a mode of arranging a head module in which the slope of the ejection volume distribution is 10 percent or less of the maximum value of the slope of the ejection volume distribution, at an arrangement position where the positive/negative sign of the slope of the ejection volume distribution switches.

In the case where head modules in which the slopes of the ejection volume distributions are positive and head modules in which the slopes of the ejection volume distributions are negative are mixed, it is more preferable to be a mode of arranging a head module in which the slope of the ejection volume distribution is zero or a head module in which the absolute value of the slope of the ejection volume distribution is the minimum, at an arrangement position where the positive/negative sign of the slope of the ejection volume distribution switches.

<Arrangement of Head Modules When Considering Impact Interference>

It can be said that the speed of a droplet is relatively high when the volume of the droplet is relatively large. It can be said that the impact position deviation is relatively small when the speed of the droplet is relatively high. As for two droplets that can contact on the medium, in consideration of the impact interference of the droplets that impact on the medium, it is desirable that the droplet having a larger volume impact earlier than the droplet having a smaller volume.

For example, focusing on the joint part 350 between the first head module 200B and the second head module 200C shown in FIG. 6, in the case where one droplet of two droplets that can contact on the medium is ejected from the nozzle part of the first head module 200B and the other droplet is ejected from the nozzle part of the second head module 200C, the one droplet ejected from the nozzle part of the first head module 200B impacts on the medium earlier than the other droplet ejected from the nozzle part of the second head module 200C.

Therefore, as for the first head module 200B and the second head module 200C, it is desirable that the head modules be arranged at the respective arrangement positions such that the ejection volume of the nozzle part arranged at the joint part 350 of the first head module 200B exceeds the ejection volume of the nozzle part arranged at the joint part 350 of the second head module 200C.

Further, it is desirable that the head modules be arranged at the respective arrangement positions such that the slope of the ejection volume distribution of the first head module 200B and the slope of the ejection volume distribution of the second head module 200C are both positive.

<Treatment When Slope of Ejection Volume Distribution is Zero>

In the case where the slope of the ejection volume distribution is zero, the slope of the ejection volume distribution is treated as being positive or negative. In the embodiment, for convenience, in the case where the slope of the ejection volume distribution is zero, the slope of the ejection volume distribution is treated as being positive.

[Description of Ink-Jet Head Production Method]

Next, an ink-jet head production method according to the embodiment is described in detail. The ink-jet head production method in the embodiment corresponds to the liquid ejection head production method.

The ink-jet head production method according to the embodiment includes a production method for the reproduction of the ink-jet head when a single or a plurality of head modules of the plurality of head modules constituting the ink-jet head is replaced.

<Overview>

In the ink-jet head production method according to the embodiment, when N is an integer of 3 or more, N head modules constituting the ink-jet head are collectively selected or are sequentially selected, and the N selected head modules are arranged in the order of the slope of the ejection volume distribution. For the ink-jet head, a target value of the average value of the ejection volume in the whole of the ink-jet head has been set in advance. Further, the head module to be used has been adjusted to an arbitrary target value of the ejection volume. It is preferable that the adjustment of the target value of the ejection volume of the head module be the adjustment to the target value of the average value of the ejection volume in the whole of the ink-jet head.

The order of the slope of the ejection volume distribution may be the ascending order, or may be the descending order. The ascending order of the slope of the ejection volume distribution in the embodiment means the case where the slope of the ejection volume distribution monotonically increases from the head module at one end of the ink-jet head 21 shown in FIG. 1 toward the head module at the other end.

Further, the descending order of the slope of the ejection volume distribution in the embodiment means the case where the slope of the ejection volume distribution monotonically decreases from the head module at one end in the longitudinal direction of the ink-jet head 21 shown in FIG. 1 toward the head module at the other end.

In the embodiment, for convenience, the one end in the longitudinal direction of the ink-jet head 21 shown in FIG. 1 is the end on the left side in FIG. 1.

<Description of Flowchart>

Figure 26:
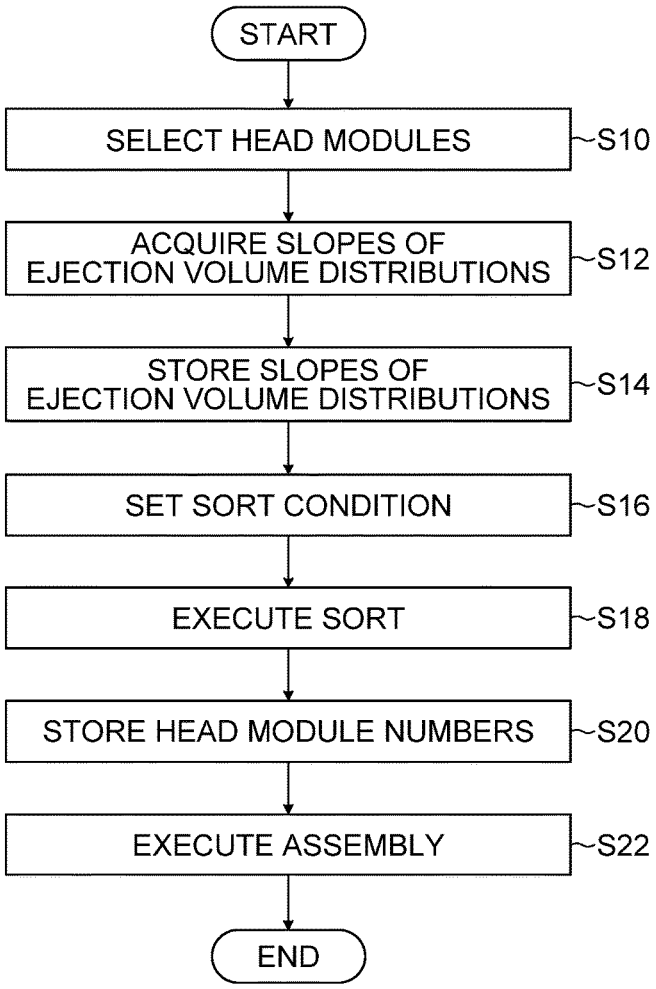
FIG. 26 is a flowchart showing a flow of the procedure of an ink-jet head production method.

FIG. 26 is a flowchart showing a flow of the procedure of an ink-jet head production method. In FIG. 26, although the illustration is omitted, the target value of the ejection volume in the whole of the ink-jet head has been set in advance. Further, each head module has been adjusted to an arbitrary target value of the ejection volume.

In a head module selection step S10 shown in FIG. 26, N head modules are selected. After the N head modules are selected, the flow proceeds to step S12.

In an ejection volume distribution slope acquisition step shown in step S12, the slope of the ejection volume distribution of each of the N head modules is acquired.

After the slope of the ejection volume distribution of each of the N head modules is acquired, the flow proceeds to step S14. In an ejection volume distribution slope storage step shown in step S14, the slope of the ejection volume distribution of each of the N head modules acquired in the ejection volume distribution slope acquisition step S12 is stored in a previously decided memory.

After the slope of the ejection volume distribution of each of the N head modules is stored in the ejection volume distribution slope storage step S14, the flow proceeds to step S16. In the sort condition setting step shown in step S16, a sort condition for a sort process is set. The sort condition includes the information of whether to execute an ascending-order sort or a descending-order sort. The sort condition may be automatically set depending on the specification of the ink-jet head, or may be manually set by an operator. The sort process herein is synonymous with the permutation process.

After the sort condition is set in the sort condition setting step S16, the flow proceeds to step S18. In a sort step shown in step S18, the sort is executed while the slope of the ejection volume distribution of each of the N head modules stored in the ejection volume distribution slope storage step S14 is adopted as the variable.

In the sort step S18, the ascending-order sort or the descending-order sort is executed based on the sort condition set in the sort condition setting step S16.

In the sort step S18, when the sort is executed while the slope of the ejection volume distribution of each of the N head modules is adopted as the variable, head module numbers of 1 to n are assigned to the N head modules respectively, based on the sort result.

After the head module numbers of 1 to n are assigned to the N head modules respectively in the sort step S18, the flow proceeds to step S20. In a head module number storage step S20 shown in step S20, the head module number n for each head module, which is the sort result in the sort step S18 and indicates the arrangement of the N head modules, is stored.

After the arrangement of the N head modules is stored in the head module number storage step S20, the flow proceeds to step S22. In an assembly step S22 shown in step S22, the N head modules are arranged based on the head module numbers assigned to the N head modules, and the assembly of the ink-jet head is executed.

In the assembly step S22, the head module numbers assigned to the N head modules may be displayed. After the assembly step S22, an inspection step of inspecting whether the N head modules are arranged in the order of the head module numbers that are decided in the order of the slope of the ejection volume distribution may be included.

The steps shown in FIG. 26 can be merged or divided when appropriate. For example, the sort condition setting step S16 and the sort step S18 may be merged, or the ejection volume distribution slope acquisition step S12 and the ejection volume distribution slope storage step S14 may be merged.

FIG. 26 exemplifies a mode of collectively selecting the N head module and collectively executing the sort process for the N head modules. However, a mode of selecting the N head modules one by one as a candidate head module, determining whether the candidate head module satisfies a magnitude relation of the slope of the ejection volume distribution with a head module for which the arrangement is previously decided, and sequentially repeating the process for the N head modules is possible.

Figure 27:
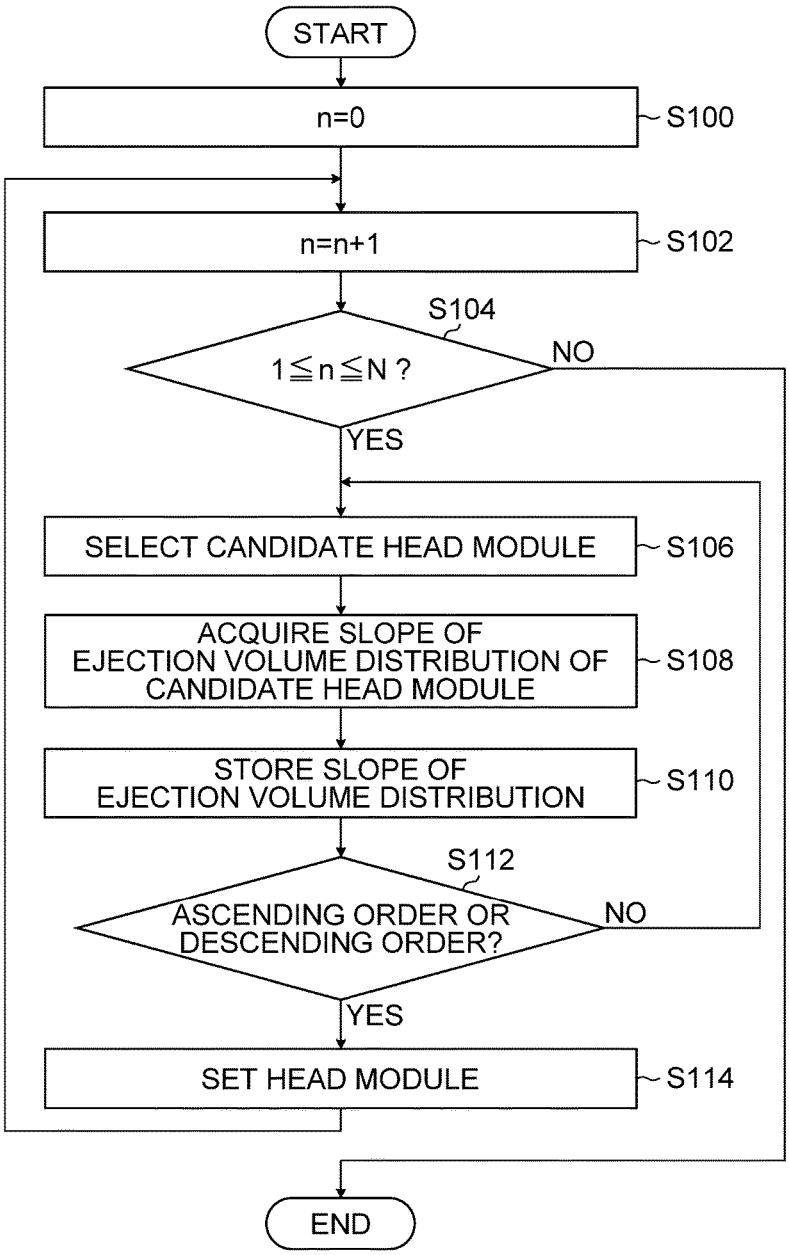
FIG. 27 is a flowchart showing a flow of the procedure of an ink-jet head production method.

FIG. 27 is a flowchart showing a flow of the procedure of an ink-jet head production method, and shows a flow of the procedure in the mode of performing the sequential process. In the ink-jet head production method described below, the head module to be arranged at the arrangement position of each head module number n is set in the order of the head module number n, from a head module whose head module number n is 1.

First, a head module whose head module number n is 1, which is a head module to be arranged at one end in the longitudinal direction of the ink-jet head, is decided. Next, a head module whose head module number n is 2 is decided.

In this way, in the order of the head module number n, head modules are decided for the arrangement positions of the head module numbers n of 1 to N.

In an initialization step shown in step S100 of FIG. 27, the head module number n is initialized. That is, zero is substituted for the head module number n.

The head module numbers n are numbers that are assigned in order from a number-1 head module, where the number-1 head module is the head module at one end in the longitudinal direction of the ink-jet head. The head module number n is an integer of 1 or more, and an integer equal to or less than the total number N of the head modules provided in the ink-jet head is used. In the embodiment, for convenience, the one end in the longitudinal direction of the ink-jet head 21 shown in FIG. 1 is the end on the left side in FIG. 1.

In a head module number advancement step shown in step S102, a process of incrementing the head module number n by one is executed. That is, after a head module to be set as the number-n head module is decided, the flow proceeds to a process of setting the number-n+1 head module.

In an all-module setting determination step shown in step S104, whether the head module number n updated in the head module number advancement step S102 has been set for all head modules that are arranged at the arrangement positions of 1 to N is determined. In the case of a NO determination in which all head modules have been decided in step S104, that is, in the case of n>N, the ink-jet head production method is ended. In the case of a YES determination in which there is an undecided head module in the all-module setting determination step S104, that is, in the case of 1≤n≤N, the flow proceeds to step S106.

In a candidate head module selection step shown in step S106, a candidate head module that is the object of the process is selected. After the candidate head module is selected in the candidate head module selection step S106, the flow proceeds to step S108. The candidate head module selection step is a mode of the head module selection step, and corresponds to the selection step of sequentially selecting three or more head modules.

In the case where the head module number n is 1, the candidate head module selection step S106 corresponds to the first candidate head module selection step of selecting the first candidate head module. In the case where the head module number n is 2 or more, the candidate head module selection step S106 corresponds to the second candidate head module selection step of selecting the second candidate head module, or the third candidate head module selection step of selecting the third candidate head module.

In an ejection volume distribution slope acquisition step shown in step S108, the slope of the ejection volume distribution of the candidate head module is acquired, and in an ejection volume distribution slope storage step shown in step S110, the acquired slope of the ejection volume distribution of the candidate head module is stored in a previously decided memory.

As the ejection volume distribution slope acquisition step S108, a mode of acquiring the slope of the ejection volume distribution of the first candidate head module, a mode of acquiring the slope of the ejection volume distribution of the second candidate head module, or a mode of acquiring the slope of the ejection volume distribution of the third candidate head module is possible. Further, a mode of acquiring the slope of the ejection volume distribution of the second candidate head module and the slope of the ejection volume distribution of the first candidate head module, or a mode of acquiring the slope of the ejection volume distribution of the third candidate head module and the slope of the ejection volume distribution of the first head module is possible.

As the ejection volume distribution slope storage step, a mode of storing the slope of the ejection volume distribution of the first candidate head module, a mode of storing the slope of the ejection volume distribution of the second candidate head module, or a mode of storing the slope of the ejection volume distribution of the third candidate head module is possible.

A mode of acquiring the slope of the ejection volume distribution of the first candidate head module as the slope of the ejection volume distribution of the first head module in the ejection volume distribution slope acquisition step S108 is possible. A mode of acquiring the slope of the ejection volume distribution of the second candidate head module as the slope of the ejection volume distribution of the second head module in the ejection volume distribution slope acquisition step S108 is possible. A mode of acquiring the slope of the ejection volume distribution of the third candidate head module as the slope of the ejection volume distribution of the third head module in the ejection volume distribution slope acquisition step S108 is possible.

After the slope of the ejection volume distribution of the candidate head module is acquired in the ejection volume distribution slope acquisition step S108 and the slope of the ejection volume distribution of the candidate head module is stored in the ejection volume distribution slope storage step 5110, the flow proceeds to step S112.

In a determination step shown in step S112, whether the slope of the ejection volume distribution of the candidate head module acquired in the ejection volume distribution slope acquisition step S108 satisfies the condition of the ascending order or descending order with the slope of the ejection volume distribution of the head module previously arranged at the position adjacent to the candidate head module is determined.

That is, in the determination step S112, whether the slope of the ejection volume distribution of the candidate head module and the slope of the ejection volume distribution of the head module previously arranged at the position adjacent to the candidate head module satisfy the relation of the ascending order or descending order for the two adjacent head modules is determined.

In the case where the head module number n is 2 or more, in the determination step S112, the slope of the ejection volume distribution of the head module that is arranged at the arrangement position adjacent to the candidate head module and that is compared with the candidate head module in the slope of the ejection volume distribution is read.

In the case where the slope of the ejection volume distribution of the candidate head module satisfies the condition of the ascending order or descending order with the slope of the ejection volume distribution of the head module previously arranged at the position adjacent to the candidate head module, which the case of the YES determination in the determination step S112, the flow proceeds to step S114. In a setting step shown in step S114, the candidate head module is set as the number-n head module. In the case where the head module number n is 1 or in the case where the head module number n is 2, the determination step S112 is skipped, and the flow proceeds to the setting step S114.

On the other hand, in the case where the slope of the ejection volume distribution of the candidate head module does not satisfies the condition of the ascending order or descending order with the slope of the ejection volume distribution of the head module previously arranged at the position adjacent to the candidate head module, which is the case of the NO determination in the determination step S112, the flow proceeds to the candidate head module selection step S106, and another head module is selected as the candidate head module. Thereafter, the steps of step S106 to step S112 are repeatedly executed until the head module to be set is found.

After the head module whose head module number is n is set in the setting step S114, the steps of step S102 to step S114 are repeatedly executed until the N head modules are set.

Thus, the ink-jet head in which three or more head modules arranged at positions that are adjacent in the longitudinal direction of the ink-jet head have an arrangement of the ascending order or descending order of the slope of the ejection volume distribution is produced.

FIG. 27 exemplifies the mode of setting the head modules in the order of the head module number from the head module whose head module number is 1 while the head module at one end of the ink-jet head is adopted as the head module whose head module number is 1. However, the head modules may be set in the order from a head module other than both ends of the ink-jet head, for example, from the head module at the center, to both sides.

In the case where the head modules are set in the order from a head module other than both ends of the ink-jet head toward both sides, by setting head modules to one end side in the descending order of the slope of the ejection volume distribution and setting head modules to the other end side in the ascending order of the slope of the ejection volume distribution, the arrangement of the head modules in which the slopes of the ejection volume distributions are in ascending order as the whole of the ink-jet head is actualized.

By setting the head modules to the one end side in the ascending order of the slope of the ejection volume distribution and setting the head modules to the other end side in the descending order of the slope of the ejection volume distribution, the arrangement of the head modules in which the slopes of the ejection volume distributions are in descending order as the whole of the ink-jet head is actualized.

In the case where the head modules are set in the order from a head module other than both ends of the ink-jet head toward both sides and where head modules in which the slopes of the ejection volume distributions are positive and head modules in which the slopes of the ejection volume distributions are negative are mixed, it is possible to perform in parallel a process for the head modules in which the slopes of the ejection volume distributions are positive and a process for the head modules in which the slopes of the ejection volume distributions are negative, by adopting, as the reference position, a position where the positive and negative of the slope of the ejection volume distribution switches.

In the embodiment, the mode in which all head modules constituting the ink-jet head are arranged in the ascending order or descending order of the slope of the ejection volume distribution had been exemplified. However, in an ink-jet head constituted by three or more head modules, it is only necessary that at least three head modules that are adjacent in the longitudinal direction of the ink-jet head are arranged in the ascending order or descending order of the slope of the ejection volume distribution.

For example, in an ink-jet head constituted by five head modules, when the three head modules except the two head modules arranged at both ends in the longitudinal direction of the ink-jet head are arranged in the ascending order or descending order of the slope of the ejection volume distribution, it is possible to secure a certain level of ejection performance, in a region where the ejection frequency is high.

<Care for Replacement of Head Module>

Figure 28:
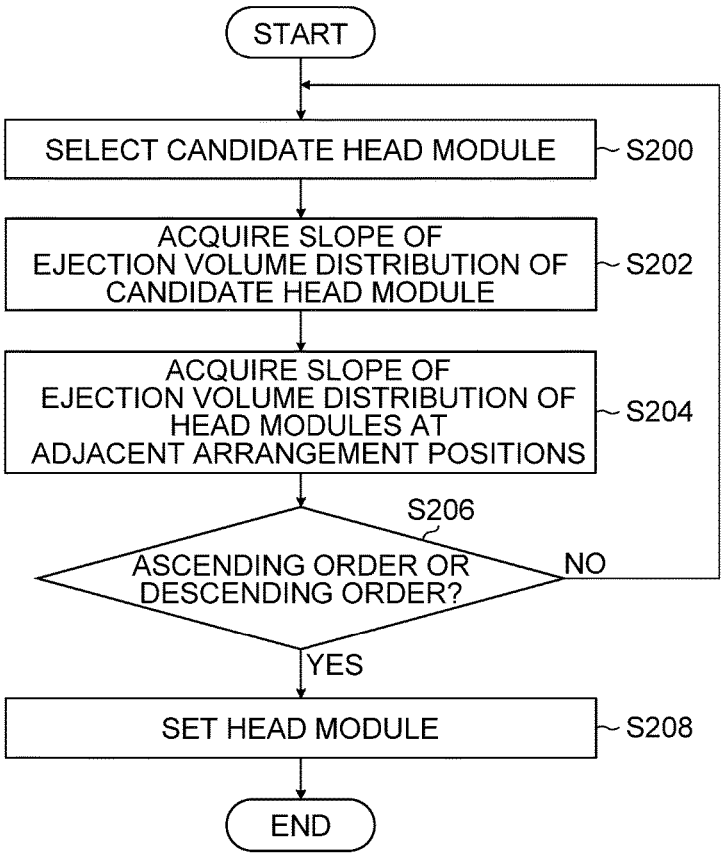
FIG. 28 is a flowchart showing a flow of an ink-jet head production method.

FIG. 28 is a flowchart showing a flow of the procedure of an ink-jet head production method, and shows a flow of the procedure in the case where an arbitrary one of the head modules constituting the ink-jet head is replaced.

The replacement procedure for the head module described below is a procedure in the case of replacing the second head module 200C of the first head module 200B, second head module 200C and third head module 200D shown in FIG. 23 and FIG. 24.

In a candidate head module selection step shown in step S200 of FIG. 28, a candidate head module to be arranged at the arrangement position of a replacement-object head module is selected. After the candidate head module is selected in the candidate head module selection step S200, the flow proceeds to step S202.

In a candidate-head-module ejection volume distribution slope acquisition step shown in step S202, the slope of the ejection volume distribution of the candidate head module is acquired. After the slope of the ejection volume distribution of the candidate head module is acquired in the candidate-head-module ejection volume distribution slope acquisition step S202, the flow proceeds to step S204.

In an adjacent-head-module ejection volume distribution slope acquisition step shown in step S204, the slopes of the ejection volume distributions of the head modules arranged at the positions adjacent to the replacement-object head module are acquired.

In the case where the replacement-object head module is other than the head modules at both ends in the longitudinal direction of the ink-jet head, the slopes of the ejection volume distributions of the head modules arranged at the adjacent positions on both sides of the replacement-object head module are acquired.

In the case where the replacement-object head module is of the head modules at both ends in the longitudinal direction of the ink-jet head, a single head module is arranged at the position adjacent to the replacement-object head module, and a single slope is acquired as the slope of the ejection volume distribution of the head module arranged at the position adjacent to the replacement-object head module.

After the slope of the ejection volume distribution of the head module arranged at the position adjacent to the replacement-object head module is acquired in the adjacent-head-module ejection volume distribution slope acquisition step S204, the flow proceeds to step S206.

In a determination step shown in step S206, whether the slope of the ejection volume distribution of the candidate head module acquired in the candidate-head-module ejection volume distribution slope acquisition step S202 and the slope of the ejection volume distribution of the head module arranged at the position adjacent to the candidate head module acquired in the adjacent-head-module ejection volume distribution slope acquisition step S204 satisfy the condition of the ascending order or descending order is determined.

In the case where the slope of the ejection volume distribution of the candidate head module and the slope of the ejection volume distribution of the head module arranged at the position adjacent to the candidate head module satisfy the condition of the ascending order or descending order, which is the case of the YES determination in the determination step S206, the flow proceeds to step S208. In a setting step shown in step S208, the candidate head module is set as the replacement-object head module.

On the other hand, in the case where the slope of the ejection volume distribution of the candidate head module and the slope of the ejection volume distribution of the head module arranged at the position adjacent to the candidate head module do not satisfy the condition of the ascending order or descending order, which is the case of the NO determination in the determination step S206, the flow proceeds to the candidate-head-module selection step S200, and another head module is selected as the candidate head module. Thereafter, the steps of step S200 to step S206 are repeatedly executed until the head module to be set is found.

After the candidate head module is set as the replacement-object head module in the setting step S208, the ink-jet head production method is ended.

Thus, when an arbitrary head module is replaced, a head module allowing the slope of the ejection volume distribution to be in ascending order or descending order is arranged at the arrangement position of the replacement-object head module, in consideration of the slopes of the ejection volume distributions of the head modules arranged at the adjacent positions, and thereby, the ejection performance of the ink-jet head is maintained even when an arbitrary head module is replaced.

[Description of Derivation of Slope of Ejection Volume Distribution]

It is preferable to acquire the slope of the ejection volume distribution for each head module at the time of the shipment inspection of the head module.

The slope of the ejection volume distribution of the head module may be evaluated from the ejection volume of all nozzle parts provided in the head module, or may be evaluated using the ejection volume of the nozzle parts arranged at the joint parts that are present on both sides of the head module in the longitudinal direction of the ink-jet head. The ejection volume of the nozzle parts may be the total sum, or may be the average value.

For example, the slope of the ejection volume distribution of the head module can be obtained by subtracting the average value of the ejection volumes of the nozzle parts arranged at the joint part on one end of the head module in the longitudinal direction of the ink-jet head from the average value of the ejection volumes of the nozzle parts arranged at the joint part on the other end of the head module in the longitudinal direction of the ink-jet head.

In the case where the average value of the ejection volumes of the nozzle parts arranged at the joint part on the one end of the head module in the longitudinal direction of the ink-jet head is 1.9 picoliter and the average value of the ejection volumes of the nozzle parts arranged at the joint part on the other end of the head module in the longitudinal direction of the ink-jet head is 2.1 picoliter, the slope of the ejection volume distribution of the head module is plus 0.2.

In the case where the average value of the ejection volumes of the nozzle parts arranged at the joint part on the one end of the head module in the longitudinal direction of the ink-jet head is 2.1 picoliter and the average value of the ejection volumes of the nozzle parts arranged at the joint part on the other end of the head module in the longitudinal direction of the ink-jet head is 1.9 picoliter, the slope of the ejection volume distribution of the head module is minus 0.2.

In the following, methods for deriving the ejection volume of each nozzle part are described. Suppose that the average of the ejection volume in the whole of each head module has been adjusted to the average ejection volume target value of the ink-jet head in advance, at the time of the execution of the methods for deriving the ejection volume of each nozzle part described below.

In other words, suppose that the amplification factor of the drive voltage of each head module has been evaluated in advance, at the time of the execution of the methods for deriving the ejection volume of each nozzle part.

In the case where redundant nozzles are included in the joint part, the ejection volumes of the redundant nozzles may be included in the ejection volume of the whole of each head module.

<Method 1>

A dot diameter evaluation chart is formed, using an object head module. Examples of the dot diameter evaluation chart include a chart in which the dots formed by the nozzle parts are arranged in an isolated state.

Figure 29:
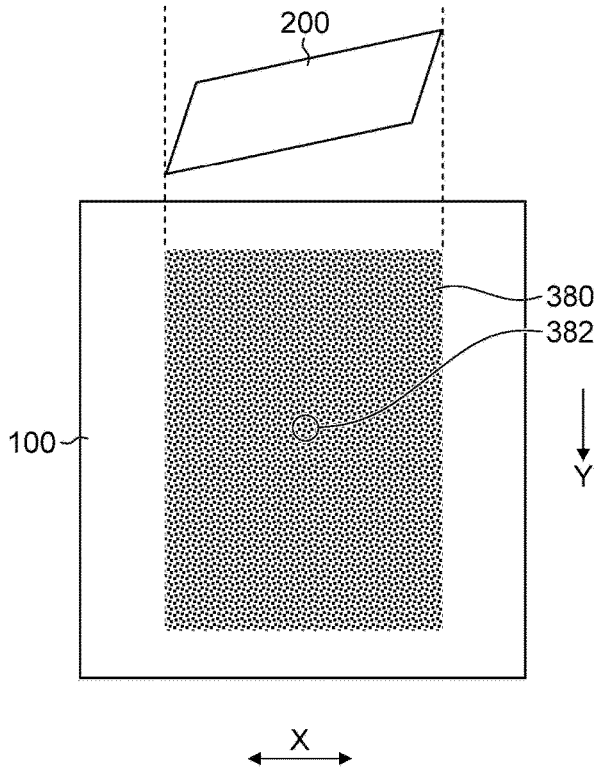
FIG. 29 is an explanatory diagram schematically showing an example of a dot diameter evaluation chart.
Figure 30:
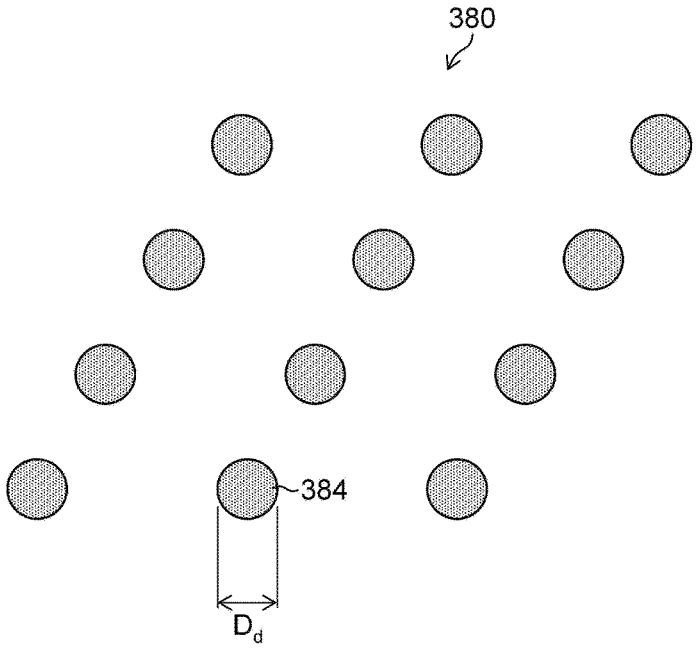
FIG. 30 is a partial enlarged view of FIG. 29.

FIG. 29 is an explanatory diagram schematically showing an example of the dot diameter evaluation chart, and schematically illustrates a dot diameter evaluation chart 380 that is formed on the medium 100 using the head module 200. FIG. 30 is a partial enlarged view of FIG. 29, and is an enlarged view of the region shown by a circle that is shown in FIG. 29 while reference numeral 382 is assigned.

The dot diameter evaluation chart 380 shown in FIG. 29 and FIG. 30 is read using a scanner, a microscope or the like, and the diameter $D_d$ of a dot 384 formed by each nozzle part is measured.

The diameter $D_d$ of the dot formed by each nozzle part can be converted into the ejection volume $V_d$ of each nozzle part, using an expansion ratio $G_{ad}$ decided from the kind of the medium 100 on which the dot diameter evaluation chart 380 is formed and the surface treatment condition of the medium 100 on which the dot diameter evaluation chart 380 is formed. The relation of the ejection volume $V_d$ of each nozzle part, the diameter $D_d$ of the dot 384 formed by each nozzle part and the expansion ratio $G_{ad}$ is expressed as $V_d=D_d/G_{ad}$.

Here, as the way to decide the expansion ratio Gad, the expansion ratio can be decided in advance, by printing the dot while feeding the medium in a state of ensuring that a liquid having a known volume is ejected from an arbitrary nozzle part, and using the known ejection volume and the diameter of the printed dot.

<Method 2>

A line width evaluation chart is formed, using an object head module. Examples of the line width evaluation chart include a chart in which lines formed by the nozzle parts and having a certain length are arranged in an isolated state.

Figure 31:
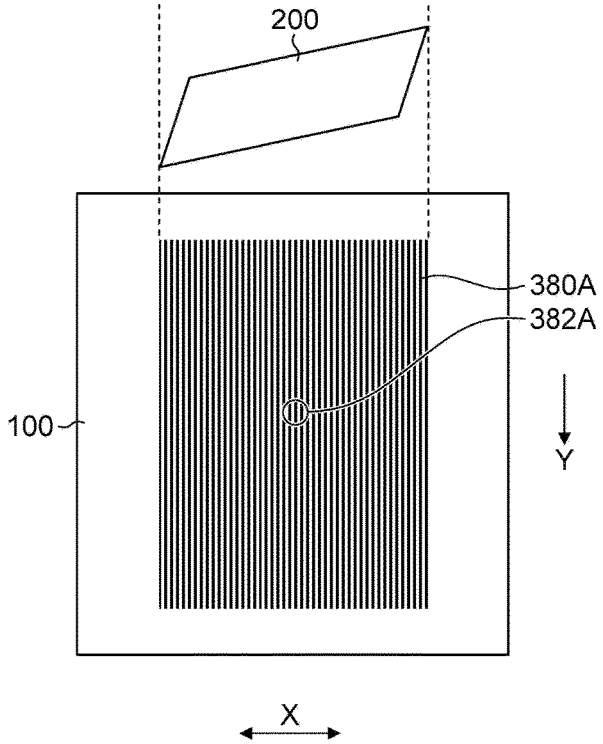
FIG. 31 is an explanatory diagram schematically showing an example of a line width evaluation chart.
Figure 32:
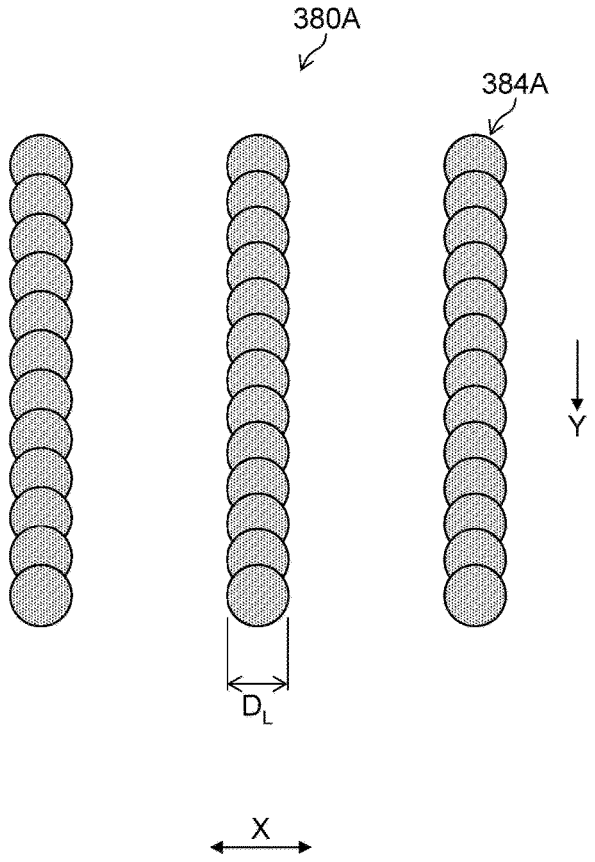
FIG. 32 is a partial enlarged view of FIG. 31.

FIG. 31 is an explanatory diagram schematically showing an example of the line width evaluation chart, and schematically illustrates a line width evaluation chart 380A that is formed on the medium 100 using the head module 200. FIG. 32 is a partial enlarged view of FIG. 31, and is an enlarged view of the region shown by a circle that is shown in FIG. 31 while reference character 382A is assigned.

The line width evaluation chart 380A shown in FIG. 31 and FIG. 32 is read using a scanner, a microscope or the like, and the width $D_L$ of a line 384A formed by each nozzle part is measured. The relation of the width $D_L$ of the line and the ejection volume $V_L$ is decided from the kind of the medium 100 on which the line width evaluation chart 380A is formed and the surface treatment condition of the medium 100 on which the line width evaluation chart 380A is formed, and therefore, by previously acquiring the information about the kind of the medium 100 on which the line width evaluation chart 380A is formed and the information about the surface treatment condition of the medium 100 on which the line width evaluation chart 380A is formed, it is possible to convert the measurement result of the width $D_L$ of the line 384A formed by each nozzle part into the ejection volume $V_L$ of each nozzle part.

The relation of the ejection volume $V_L$ of each nozzle part, the width $D_L$ of the line 384A formed by each nozzle part and a coefficient $G_{aL}$ to be decided from the kind or surface treatment condition of the medium 100 can be expressed as $V_L=D_L/G_{aL}$.

<Method 3>

The mass of the liquid ejected from each nozzle part of an object head module is measured, and the mass of the liquid ejected from each nozzle part is converted into the volume. For example, the ejection is performed from each nozzle part of the object head module a previously decided number of times, and the mass difference of the medium between before and after the ejection is measured. It is possible to keep the measurement accuracy constant, by increasing the number of times of the ejection. It is preferable that the number of times of the ejection be approximately ten thousands to one million.

The mass difference of the medium between before and after the ejection is the mass of the liquid that is ejected a previously decided number of times of the ejection. The mass of the liquid can be converted into the volume, using the specific gravity of the liquid.

The relation of the ejection volume $V_w$ of each nozzle part, the mass W of the liquid ejected from each nozzle part, the specific gravity $d_w$ of the liquid and the number $T_w$ of times of the ejection of each nozzle part can be expressed as $V_w=W/T_w/d_w$.

For maintaining a certain level of measurement accuracy and shortening the measurement period, the ejections from a plurality of nozzle parts may be simultaneously performed a previously decided number of times, and the mass difference of the medium between before and after the ejection may be measured. When the nozzle parts arranged at the joint part are applied as the plurality of nozzle parts, the mass of the liquid that is ejected from the nozzle parts arranged at the joint part is measured, and the ejection volume of the nozzle parts arranged at the joint part is evaluated.

Figure 33:
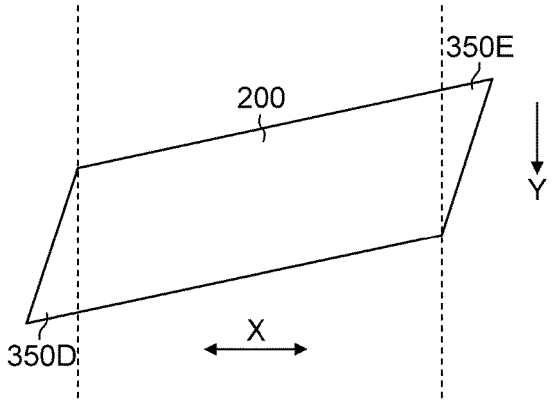
FIG. 33 is an explanatory diagram of an example in which nozzle parts arranged at the joint part are applied as a plurality of nozzle parts.

FIG. 33 is an explanatory diagram of an example in which the nozzle parts arranged at the joint part are applied as the plurality of nozzle parts. As shown in FIG. 33, the ejection volume of the nozzle parts arranged at a joint part 350D on one end side in the longitudinal direction of the ink-jet head and the ejection volume of the nozzle parts arranged at a joint part 350E on the other end side in the longitudinal direction of the ink-jet head are measured.

The ejection volume of each nozzle part in the case of using a plurality of nozzle parts is the value resulting from dividing the ejection volume $V_W$ of the nozzle parts in the above formula by the number of the nozzle parts that are measurement objects, and is evaluated as the average value of the ejection volume in the ejection when the plurality of nozzle parts are used.

<Modification of Method 3>

When the ejection volume is collectively measured for a plurality of nozzle parts in Method 3, all nozzle parts belonging to the nozzle array along the W-direction shown in FIG. 3 can be applied as the plurality of nozzle parts. Further, the nozzle array may be a single array, or may be a plurality of arrays.

<Method 4>

The ejection volume of the liquid can be measured using a micro-syringe, instead of the mass measurement of the liquid in Method 3.

Figure 34:
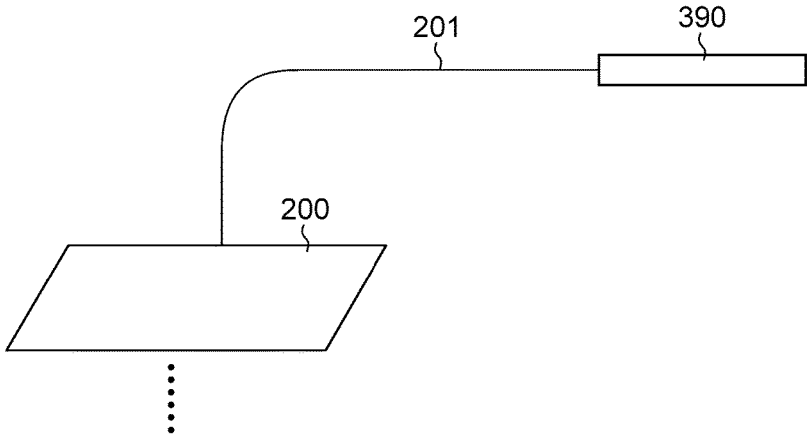
FIG. 34 is an explanatory diagram schematically showing the measurement of the ejection volume of liquid with use of a micro-syringe.

FIG. 34 is an explanatory diagram schematically showing the measurement of the ejection volume of the liquid with use of the micro-syringe. As shown in FIG. 34, a micro-syringe 390 is attached to a liquid supply part 201 of the head module 200, and the movement amount on a scale of the micro-syringe 390 is measured.

The relation of the ejection volume $V_s$ of each nozzle part, the movement amount S on the scale of the micro-syringe, the number $T_s$ of times of the ejection of each nozzle part and the density $D_s$ of the liquid can be expressed as $V_s=S/T_s/D_s$.

<Modification of Method 4>

When the ejection volume is collectively measured for a plurality of nozzle parts in Method 4, all nozzle parts belonging to the nozzle array along the W-direction shown in FIG. 3 can be applied as the plurality of nozzle parts. Further, the nozzle array may be a single array, or may be a plurality of arrays. Furthermore, in the case where the nozzle parts to be arranged at the joint part are decided, the nozzle parts to be arranged at the joint part may be applied as the plurality of nozzle parts.

<Method 5>

In the case where the ejection volume distribution of the head module can be approximated by a straight line, the slope of the ejection volume distribution of the head module can be measured by measuring the ejection volume of the whole of the head module and using the measurement result of the ejection volume of the whole of the head module. Method 5 is a measurement method by which the measurement error is small and the measurement accuracy is high.

Figure 35:
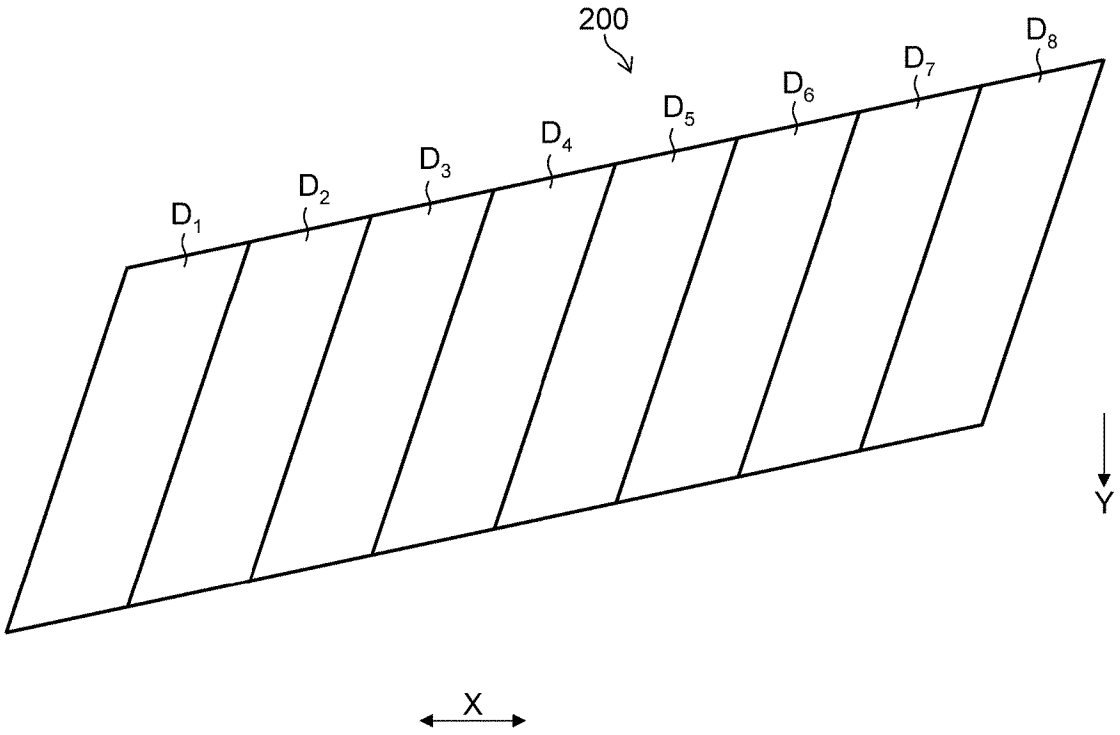
FIG. 35 is a conceptual diagram of the measurement of slope of ejection volume distribution according to Method 5.
Figure 36:
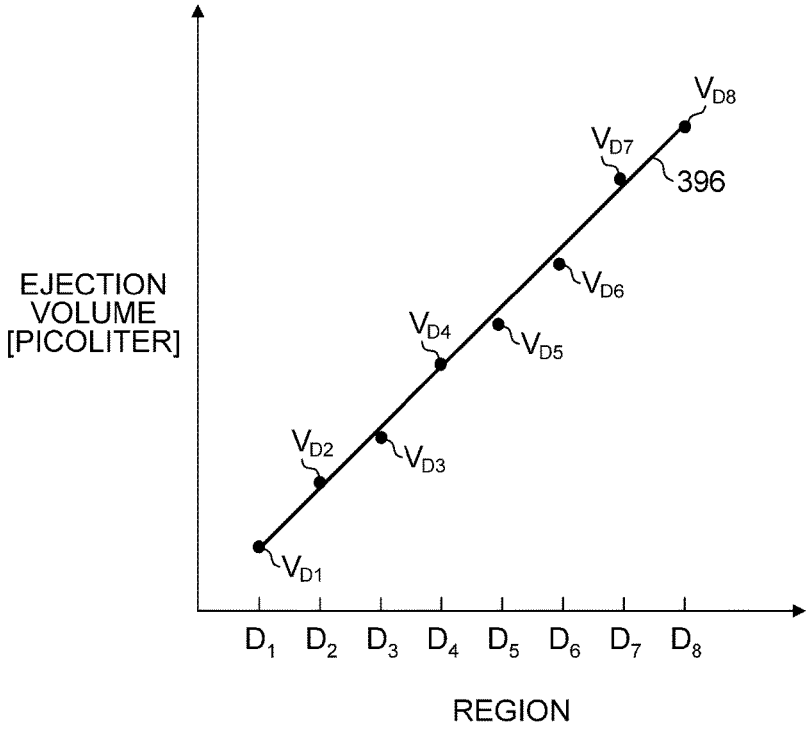
FIG. 36 is an explanatory diagram of the slope of the ejection volume distribution of the head module that is derived by Method 5.

FIG. 35 is a conceptual diagram of the measurement of the slope of the ejection volume distribution according to Method 5. FIG. 36 is an explanatory diagram of the slope of the ejection volume distribution of the head module that is derived by Method 5.

First, a head module filled with the liquid is prepared. As shown in FIG. 35, the whole of the head module 200 is divided into eight regions $D_1$ to $D_8$. The division number of the head module 200 only needs to be three or more. By increasing the division number of the head module 200, it is possible to improve the measurement accuracy. By decreasing the division number of the head module 200, it is possible to shorten the measurement period and the computation period for the measurement result.

The ejection volume is measured for each of the eight regions $D_1$ to $D_8$. As the measurement of the ejection volume, Method 3 can be applied. For example, the number of the nozzle parts of each of the regions $D_1$ to $D_8$ is set to 256, the ejection is performed from each nozzle part to the medium hundred thousand times, the mass of the liquid is measured, and the average value of the ejection volume is derived for each region.

The relation of the ejection volume $V_D$, the mass $W_D$ of the liquid, the number $T_D$ of times of the ejection and the density $D_{eD}$ of the liquid is expressed as the ejection volume $V_D=W_D/T_D/D_{eD}$. Here, the number of the nozzle parts can be arbitrarily set.

As shown in FIG. 36, an approximation straight line 396 of the ejection volume distribution of the head module 200 shown in FIG. 35 is derived based on the respective ejection volumes $V_{D1}$ to $V_{D8}$ for the regions $D_1$ to $D_8$ derived by the above formula. $V_D$ is the collective expression of $V_{D1}$ to $V_{D8}$.

Then, the value of the ejection volume for the region $D_1$ on the approximation straight line 396 shown in FIG. 36 is subtracted from the value of the ejection volume for the region $D_8$ on the approximation straight line 396, and thereby, the slope of the ejection volume distribution of the head module 200 shown in FIG. 35 is derived.

<Method 6>

Figure 37:
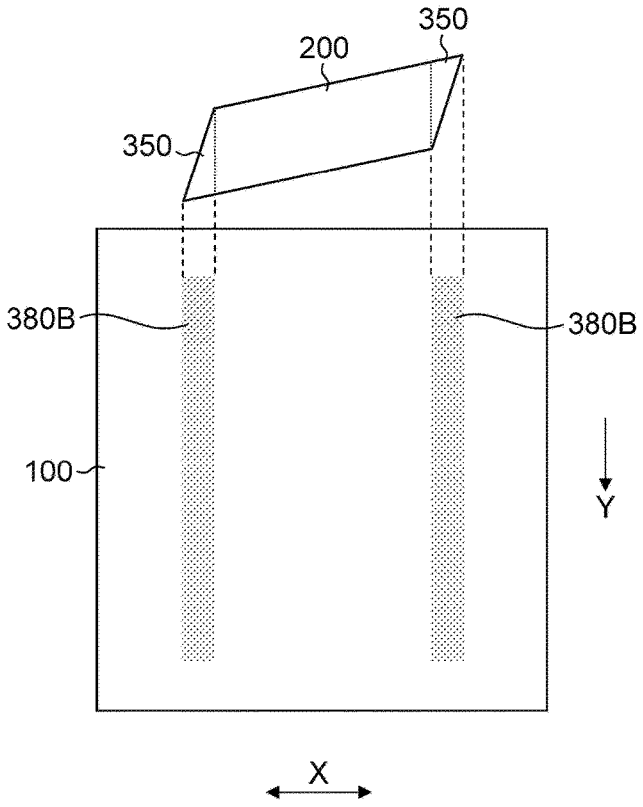
FIG. 37 is an explanatory diagram schematically showing a measurement method for the ejection volume at the joint part with use of a density evaluation pattern.

FIG. 37 is an explanatory diagram schematically showing a measurement method for the ejection volume at the joint part with use of a density evaluation pattern. In Method 6, using the nozzle parts arranged at the joint part 350 of the head module 200, a density evaluation pattern 380B is formed on the medium 100, the density of the density evaluation pattern 380B is measured, and the measured density value of the density evaluation pattern 380B is converted into the ejection volume of the nozzle parts arranged at the joint part 350 of the head module 200.

First, the head module 200 filled with the liquid, and the medium 100 on which the density evaluation pattern 380B is formed are prepared. The density evaluation pattern 380B is formed on the medium 100, by ejecting the liquid from the nozzle parts arranged at the joint part 350 of the head module 200 while feeding the medium 100.

The feed direction of the medium 100 is the medium feed direction shown in FIG. 1 while reference character Y is assigned. The length of the density evaluation pattern 380B in the medium feed direction is decided from the standpoint of the accuracy of the density measurement of the density evaluation pattern 380B. For the density measurement of the density evaluation pattern 380B, an optical densitometer can be used. The optical densitometer may be a reflection type, or may be a transmission type.

The relation of the average value $V_{DEN}$ of the ejection volumes of the nozzle parts arranged at the joint part 350 of the head module 200 and the density measurement value $M_V$ is expressed as $V_{DEN}=M_V/K_{DEN}$. Here, $K_{DEN}$ is a constant.

The constant $K_{DEN}$ is a constant that is decided based on the kind of the medium 100 and the kind of the liquid. For example, in a state of ensuring that a liquid having a known volume is ejected from an arbitrary nozzle part, a pattern for density measurement that is the same as the density evaluation pattern 380B shown in FIG. 37 is formed, and the density of the pattern for density measurement is measured. Thereby, the constant $K_{DEN}$ can be derived from the measurement value of the pattern for density measurement and the known ejection volume. It is preferable that the constant $K_{DEN}$ be derived for each density setting value.

The constant $K_{DEN}$ derived in this way is associated with the kind of the medium and the kind of the liquid, and is stored.

The ejection volume of the nozzle parts arranged at the joint part 350 of the head module 200 is evaluated from the density measurement value of the density evaluation pattern 380B shown in FIG. 37, and then, the slope of the ejection volume distribution is evaluated from the ejection volume of the nozzle parts arranged at the joint part 350 of the head module 200.

<Condition of Ejection Volume Measurement>

In the measurement of the ejection voltage of each nozzle part, it is preferable to perform the ejection while applying the highest printing duty that can be used in the actual printing. The printing duty corresponds to the liquid ejection duty.

Generally, in the ink-jet head, in the case where the ejection volume to be ejected in a unit of time within the same head module is relatively large, a cross talk occurs, and the ejection volume distribution within the head module changes. In addition, in the image quality for the case where the printing duty is high, the unevenness is visually recognized more easily than in the image quality for the case where the printing duty is low.

Therefore, it is preferable to evaluate the ejection volume for each nozzle part, using the measurement value of the ink ejected by applying the highest printing duty, which is an ejection condition in which a cross talk occurs easily and the unevenness is visually recognized easily.

Here, the high duty, as a guide, may be 80 percent or more of the maximum value of the volume of the ink droplet that can be used in the actual printing. In the case where multiple kinds of ink droplets different in volume are used in the actual printing, the maximum value of the volume of the ink droplet can be evaluated by multiplying the volumes of the respective kinds of ink droplets by the use ratios and adding the resulting values with respect to all kinds of ink droplets that are used.

For example, in the case where two droplet types of 2.0 picoliter and 6.0 picoliter are used at a use ratio of 50 percent, the maximum value of the volume of the ink droplet is calculated to 4.0 picoliter, and therefore, a printing duty by which the volume of the ink droplet is 3.2 picoliter or more and 4.0 picoliter or less may be applied.

Examples of the dot diameter evaluation chart to be formed in the above Method 1 include a configuration in which a high density pattern is formed by applying the highest printing duty, ink droplets having the smallest volume that is used in printing are ejected from the nozzle parts after the formation of the high density pattern and the ink droplets ejected from the nozzle parts are discretely arranged.

[Application Example of System Invention]

It is possible to configure an ink-jet head production system that includes an apparatus corresponding to the steps shown in FIG. 26 to FIG. 28.

Figure 38:
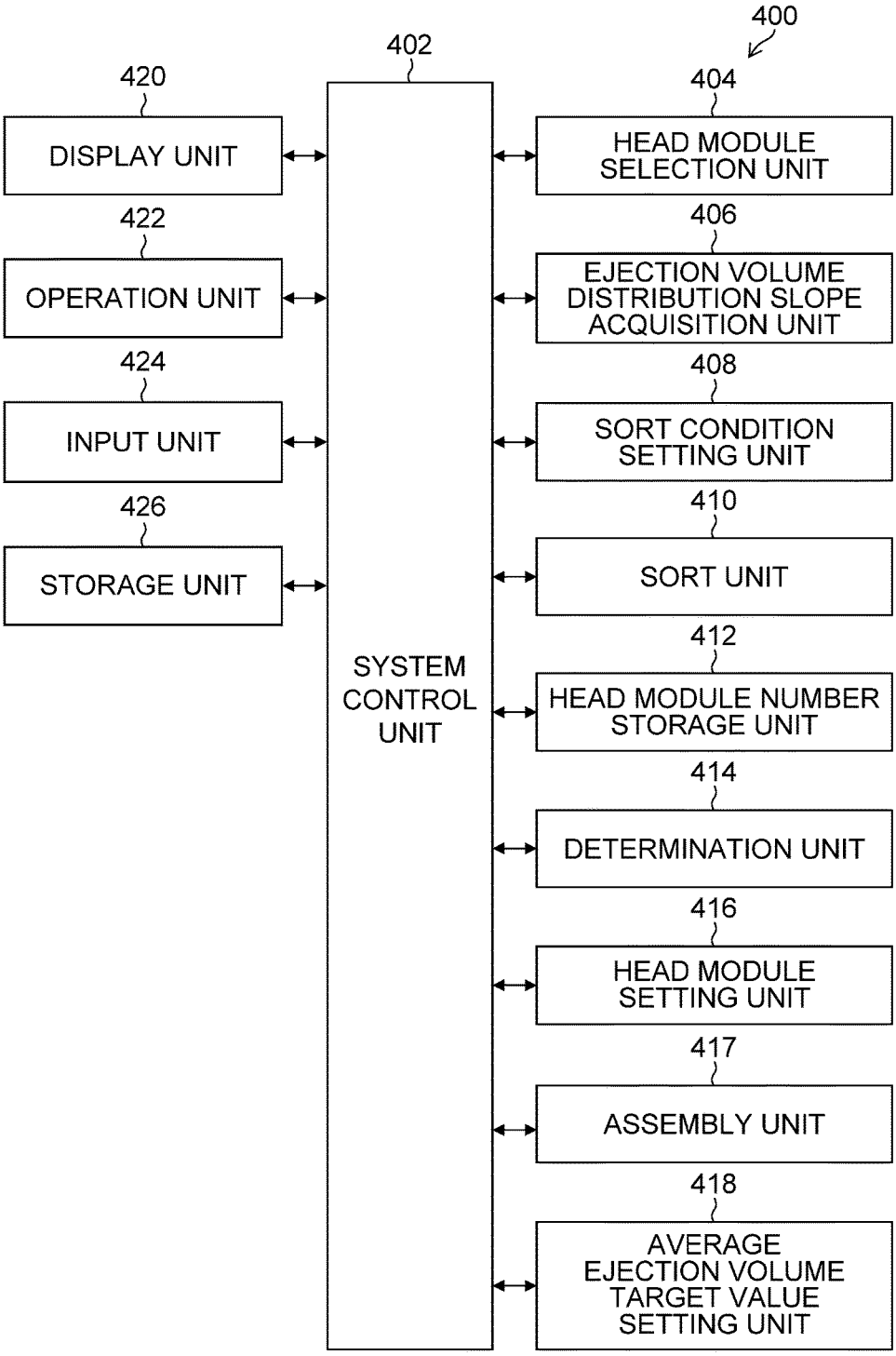
FIG. 38 is a block diagram showing a schematic configuration of an ink-jet head production system.

FIG. 38 is a block diagram showing a schematic configuration of the ink-jet head production system. The ink-jet head production system in the embodiment is a mode of the liquid ejection head production system.

In an ink-jet head production system 400 shown in FIG. 38, a system control unit 402 integrally controls the units of the system.

The ink-jet head production system 400 includes a head module selection unit 404 that selects head modules that are candidates to be arranged at the arrangement positions of the head module numbers of 1 to n, an ejection volume distribution slope acquisition unit 406 that acquires the slopes of the ejection volume distributions of the head modules selected by the head module selection unit 404, a sort condition setting unit 408 that sets a sort condition for sorting the head modules selected by the head module selection unit 404 while adopting the slope of the ejection volume distribution as the variable, and a sort unit 410 that executes the sort based on the sort condition set by the sort condition setting unit 408.

The ink-jet head production system 400 includes a storage unit 412 in which the head module numbers respectively decided for the head modules based on the sort result of the sort unit 410 are stored.

Further, the ink-jet head production system 400 can include devices that actualize the functions and processes of the steps in the ink-jet head production method described previously. The ink-jet head production system 400 includes a determination unit 414 that determines whether the slopes of the ejection volume distributions of three or more adjacent head modules are in the ascending order or descending order, a head module setting unit 416 that sets, as the three or more adjacent head modules, head modules for which the determination unit 414 determines that the slopes of the ejection volume distributions are in the ascending order or descending order, an assembly unit 417 that executes the arrangement based on the arrangement order set by the head module setting unit 416, and an average ejection volume target value setting unit 418 that sets the target value of the ejection volume in the whole of the ink-jet head.

Furthermore, the ink-jet head production system 400 includes a display unit 420 that functions as a device that displays a variety of information, an operation unit 422 such as a keyboard and a mouse, an input unit 424 that functions as an input device for the information acquired from the exterior, and a storage unit 426 in which at least one piece of information of a variety of input information and the information to be used for computation and determination is stored.

Each constituent of the ink-jet head production system 400 shown in FIG. 38 can be modified, deleted or added, when appropriate.

Furthermore, the above ink-jet head production system can function as a production support system that supports the optimization of the arrangement of the head modules.

[Configuration Example of Apparatus to Which Liquid Ejection Head is Applied]

Next, a configuration example of an apparatus to which an ink-jet head according to the embodiment is applied is described. In a liquid ejection apparatus including multiple ink-jet heads, which is an apparatus including an ink-jet head for each of multiple kinds of liquid, it is preferable to be a mode of having an identical configuration for all ink-jet heads.

In an ink-jet recording apparatus that forms a color image using multiple colors, for example, in the case where all head modules are arranged in the ascending order of the slope of the ejection volume distribution in an ink-jet head corresponding to an arbitrary one color, all head modules are arranged in the ascending order of the slope of the ejection volume distribution, also in ink-jet heads corresponding to the other colors.

In the ink-jet recording apparatus that forms a color image using multiple colors, when the slopes of the ejection volume distributions are in the ascending order or descending order for all ink-jet heads in this way, the appearance of the color deviation at the central part in the longitudinal direction of the ink-jet head is suppressed.

In the embodiments in the present invention described above, the constituent elements can be modified, added or deleted, when appropriate, in a range without departing from the spirit of the present invention. The present invention is not limited to the embodiments described above, and many modifications can be made by a person having common knowledge in the art, within the technical idea of the present invention.

What is claimed is:

1. A liquid ejection head having a structure in which three or more head modules are arranged along a single direction, each of the three or more head modules including a plurality of ejection elements, the liquid ejection head comprising:

a first head module;

a second head module that has a joint part with the first head module on one end side in the single direction, the second head module being arranged at an arrangement position that is adjacent to other end side of the first head module in the single direction; and a third head module that has a joint part with the second head module on one end side in the single direction, the third head module being arranged at an arrangement position that is adjacent to other end side of the second head module in the single direction, the first head module, the second head module and the third head module being arranged in ascending order of slope of ejection volume distribution in the single direction or being arranged in descending order of the slope of the ejection volume distribution in the single direction, the slope of the ejection volume distribution in the single direction being evaluated by subtracting an ejection volume at one end part in the single direction from an ejection volume at the other end part in the single direction.

2. The liquid ejection head according to claim 1, wherein all head modules including the first head module, the second head module and the third head module are arranged in the ascending order of the slope of the ejection volume distribution in the single direction or are arranged in the descending order of the slope of the ejection volume distribution in the single direction.

3. The liquid ejection head according to claim 1, wherein, in the first head module, the second head module and the third head module, the slopes of the ejection volume distributions in the single direction are all positive or all negative.

4. The liquid ejection head according to claim 1, wherein, in all head modules including the first head module, the second head module and the third head module, the slopes of the ejection volume distributions in the single direction are all positive or all negative.

5. The liquid ejection head according to claim 1, wherein, in head modules that are of the first head module, the second head module and the third head module and that are arranged at adjacent arrangement positions, an ejection volume of an ejection element provided in a head module in which an ejected liquid impacts earlier exceeds an ejection volume of an ejection element provided in a head module in which an ejected liquid impacts later.

6. The liquid ejection head according to claim 1, wherein each of the first head module, the second head module and the third head module includes an ejection volume distribution slope storage unit in which the slope of the ejection volume distribution in the single direction is stored.

7. The liquid ejection head according to claim 1, wherein, for the first head module, the second head module and the third head module, the slope of the ejection volume distribution in the single direction is derived using a measurement value, the measurement value being obtained by measuring a liquid that is ejected by applying an ejection duty, the ejection duty being 80 percent or more of the maximum value of the ejection volume of a droplet that is used in liquid ejection.

8. A liquid ejection head production method for producing a liquid ejection head having a structure in which three or more head modules are arranged along a single direction, each of the three or more head modules including a plurality of ejection elements, the liquid ejection head production method comprising:

a selection step of collectively selecting three or more head modules or sequentially selecting three or more head modules;

an ejection volume distribution slope acquisition step of acquiring slope of ejection volume distribution in the single direction, for each of the three or more head modules selected in the selection step, the slope of the ejection volume distribution in the single direction being derived from an ejection volume at one end part in the single direction and an ejection volume at other end part in the single direction;

a setting step of setting an arrangement in ascending order or descending order of the slope of the ejection volume distribution in the single direction for the three or more head modules acquired in the ejection volume distribution slope acquisition step; and an assembly step of arranging a first head module, a second head module and a third head module along the single direction, based on the arrangement order set in the setting step.

9. The liquid ejection head production method according to claim 8, wherein a first candidate head module that is a candidate for the first head module is selected in the selection step, the slope of the ejection volume distribution of the first candidate head module is acquired in the ejection volume distribution slope acquisition step, and the first candidate head module is set in the setting step as a head module that is arranged at an arrangement position of the first head module.

10. The liquid ejection head production method according to claim 8, wherein a second candidate head module that is a candidate for the second head module is selected in the selection step, the slope of the ejection volume distribution of the first head module and the slope of the ejection volume distribution of the second candidate head module are acquired in the ejection volume distribution slope acquisition step, and the second candidate head module is set in the setting step as a head module that is arranged at an arrangement position of the second head module, in a case where the slope of the ejection volume distribution of the first head module and the slope of the ejection volume distribution of the second candidate head module satisfy a relation of the ascending order or the descending order for the first head module and the second head module.

11. The liquid ejection head production method according to claim 8, wherein a third candidate head module that is a candidate for the third head module is selected in the selection step, the slope of the ejection volume distribution of the second head module and the slope of the ejection volume distribution of the third candidate head module are acquired in the ejection volume distribution slope acquisition step, and the third candidate head module is set in the setting step as a head module that is arranged at an arrangement position of the third head module, in a case where the slope of the ejection volume distribution of the second head module and the slope of the ejection volume distribution of the third candidate head module satisfy a relation of the ascending order or the descending order for the second head module and the third head module.

12. A liquid ejection head production system for producing a liquid ejection head having a structure in which three or more head modules are arranged along a single direction, each of the three or more head modules including a plurality of ejection elements, the liquid ejection head production system comprising:

a selection unit that selects three or more head modules;

an election volume distribution slope acquisition unit that acquires slope of ejection volume distribution in the single direction, for each of the three or more head modules selected by the selection unit, the slope of the ejection volume distribution in the single direction being derived from an ejection volume at one end part in the single direction and an ejection volume at other end part in the single direction;

a head module setting unit that sets an arrangement in ascending order or descending order of the slope of the ejection volume distribution in the single direction for the three or more head modules acquired by the ejection volume distribution slope acquisition unit; and an assembly unit that arranges a first head module, a second head module and a third head module along the single direction, based on the arrangement order set by the head module setting unit.

* * * * *